US010046951B2

(12) United States Patent
Turek et al.

(10) Patent No.: US 10,046,951 B2
(45) Date of Patent: Aug. 14, 2018

(54) FIXING MODULES AND PALLETS FOR A PALLET CONVEYOR

(71) Applicant: Otis Elevator Company, Farmington, CT (US)

(72) Inventors: Alexander Turek, Münchendorf (AT); Goetz Metzdorf, Vienna (AT); Martin Michalke, Brunn am Gebirge (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/487,138

(22) Filed: Apr. 13, 2017

(65) Prior Publication Data

US 2017/0297872 A1 Oct. 19, 2017

(30) Foreign Application Priority Data

Apr. 15, 2016 (EP) ..... 16165599

(51) Int. Cl.

| | |
|---|---|
| ***B66B 23/02*** | (2006.01) |
| ***B66B 23/08*** | (2006.01) |
| ***B66B 23/12*** | (2006.01) |
| ***B66B 23/00*** | (2006.01) |
| *B66B 21/10* | (2006.01) |

(52) U.S. Cl.

CPC ..... *B66B 23/028* (2013.01); *B66B 23/00* (2013.01); *B66B 23/022* (2013.01); *B66B 23/08* (2013.01); *B66B 23/12* (2013.01); *B66B 21/10* (2013.01)

(58) Field of Classification Search

CPC ..... B66B 23/028

See application file for complete search history.

(56) References Cited

U.S. PATENT DOCUMENTS

| | | | |
|---|---|---|---|
| 3,964,596 | A | 6/1976 | Heusler et al. |
| 4,244,457 | A | 1/1981 | Werner |
| 4,645,059 | A | 2/1987 | Hoefling et al. |
| 5,072,821 | A | 12/1991 | Kruse et al. |

(Continued)

FOREIGN PATENT DOCUMENTS

| | | |
|---|---|---|
| DE | 3828914 A1 | 3/1990 |
| EP | 0795512 B1 | 7/2000 |

(Continued)

OTHER PUBLICATIONS

European Search Report for application EP 16165599.8, dated Nov. 18, 2016, 6pgs.

(Continued)

*Primary Examiner* — Thomas Randazzo

(74) *Attorney, Agent, or Firm* — Cantor Colburn LLP

(57) ABSTRACT

A fixing module (2) for fixing a pallet (8) of a pallet conveyor, in particular a people conveyor, to a pallet chain (40; 50; 90) comprises a pallet side (4) comprising a connection portion (6), which is configured to be fixed in a non-rotatable manner to a pallet (8) of a pallet conveyor; a pallet chain side (10), which is configured for facing the pallet chain (40; 50; 90) and for receiving at least one fixing element (47) protruding from the pallet chain (40; 50; 90); and a securing mechanism (12, 14, 16), comprising at least one moveable securing element (12) which is configured for securing the at least one fixing element (47) within the fixing module (2) so that the fixing module (2) is non-rotatably fixed to the pallet chain (40; 50; 90).

17 Claims, 23 Drawing Sheets

(56) References Cited

U.S. PATENT DOCUMENTS

| | | | | |
|---|---|---|---|---|
| 5,785,166 | A | 7/1998 | Hoefling et al. | |
| 6,085,891 | A | 7/2000 | Behle | |
| 7,410,043 | B2 | 8/2008 | Aulanko et al. | |
| 8,931,614 | B2 | 1/2015 | Senger | |
| 9,682,847 | B2 * | 6/2017 | Matheisl | B66B 23/10 |
| 2007/0029162 | A1 * | 2/2007 | Aulanko | B65G 17/42 198/333 |
| 2015/0344269 | A1 | 12/2015 | Makovec et al. | |

FOREIGN PATENT DOCUMENTS

| | | | |
|---|---|---|---|
| WO | 2005073112 | A3 | 8/2005 |
| WO | 2013152714 | A1 | 10/2013 |
| WO | 2015010894 | A1 | 1/2015 |
| WO | 2015032674 | A1 | 3/2015 |
| WO | 2015058909 | A1 | 4/2015 |
| WO | 2015180964 | A1 | 12/2015 |

OTHER PUBLICATIONS

KONE Corp, "Planning Guide for KONE Escalators & Autowalks", available at: http://www.kone.us/Images/KONE-Escalator-AutoWalk-Planning-Guide_tcm25-18783.pdf, dated Oct. 1, 2010, 64pgs.

* cited by examiner

FIXING MODULES AND PALLETS FOR A PALLET CONVEYOR

PRIORITY

This application claims priority to European Patent Application No. 16165599.8, filed 15 Apr. 2016, and all the benefits accruing therefrom under 35 U.S.C. § 119, the contents of which in its entirety are herein incorporated by reference.

BACKGROUND

The invention relates to the problem of fixing a pallet of a pallet conveyor, e.g. a people conveyor such as an escalator or moving walkway, to a pallet chain.

The invention in particular relates to a fixing module which is configured for fixing a pallet of a pallet conveyor to a pallet chain. The invention further relates to a pallet including a fixing portion for fixing the pallet to a pallet chain. Exemplary embodiments of the invention further include a pallet assembly, a pallet chain, a pallet conveyor drive mechanism and a pallet conveyor employing such a fixing module or pallet.

Within the scope of this disclosure, the term "pallet" is to be understood as including planar pallets, as they are used in moving walkways, as well as steps or elements of steps, as they are used in escalators.

Pallet conveyors comprise a plurality of pallets forming an endless pallet band moving in a conveying direction between turnaround sections. The pallets are drivingly coupled to at least one pallet chain. The at least one pallet chain is coupled to a drive and drives the endless pallet band in the conveying direction. Typically, two pallet chains are connected to the pallet band, extending on both sides of the pallet band in the conveying direction and driving the pallet band in the conveying direction, respectively.

It would be beneficial to provide improved fixing mechanisms which allow for easy installation and maintenance of the pallets and the pallet chain, particularly in case of a small pallet chain pitch and small pallet chain roller diameters.

SUMMARY

A fixing module according to an exemplary embodiment of the invention, which is configured for fixing a pallet of a pallet conveyor to a pallet chain, comprises: a pallet side comprising a connection portion, which is configured to be fixed in a non-rotatable manner to a pallet of a pallet conveyor; a pallet chain side, which is configured for facing the pallet chain and for receiving at least one fixing element protruding from the pallet chain; and a securing mechanism, comprising at least one moveable securing element which is configured for securing the at least one fixing element within the fixing module so that the fixing module is non-rotatably fixed to the pallet chain.

A pallet for a pallet conveyor according to an exemplary embodiment of the invention comprises a receiving space which is configured for receiving the connection portion of such a fixing module.

Exemplary embodiments of the invention further include a pallet assembly comprising such a pallet and a fixing module according to an exemplary embodiment of the invention.

A pallet for a pallet conveyor according to another exemplary embodiment of the invention has a fixing portion which comprises: a pallet chain side, which is configured for facing the pallet chain and for receiving at least one fixing element extending from the pallet chain; and a securing mechanism which comprises at least one moveable securing element which is configured for securing the at least one fixing element within the pallet so that the pallet is non-rotatably fixed to the pallet chain.

Embodiments of the invention further include a pallet chain comprising a plurality of pallet chain links connected by pallet chain bolts, wherein at least part of the pallet chain bolts protrude from the pallet chain links and are configured for being received by a pallet chain side of a fixing module as described herein, or by a fixing portion of a pallet as described herein.

Exemplary embodiments of the invention also include a pallet conveyor drive mechanism comprising a plurality of pallets and/or fixing modules according to exemplary embodiments of the invention and at least one pallet chain, in particular a pallet chain according to an exemplary embodiment of the invention.

Exemplary embodiments of the invention further include a pallet conveyor comprising a pallet conveyor drive mechanism according to an exemplary embodiment of the invention.

A fixing module and/or a pallet according to exemplary embodiments of the invention allow for a small pallet chain pitch and small chain roll diameters. They further facilitate the machining of the pallet chain links and allow for easy installation and maintenance of the pallet conveyor.

BRIEF DESCRIPTION OF THE DRAWINGS

In the following, exemplary embodiments of the invention are described with respect to the enclosed figures.

DETAILED DESCRIPTION

Figure 1:
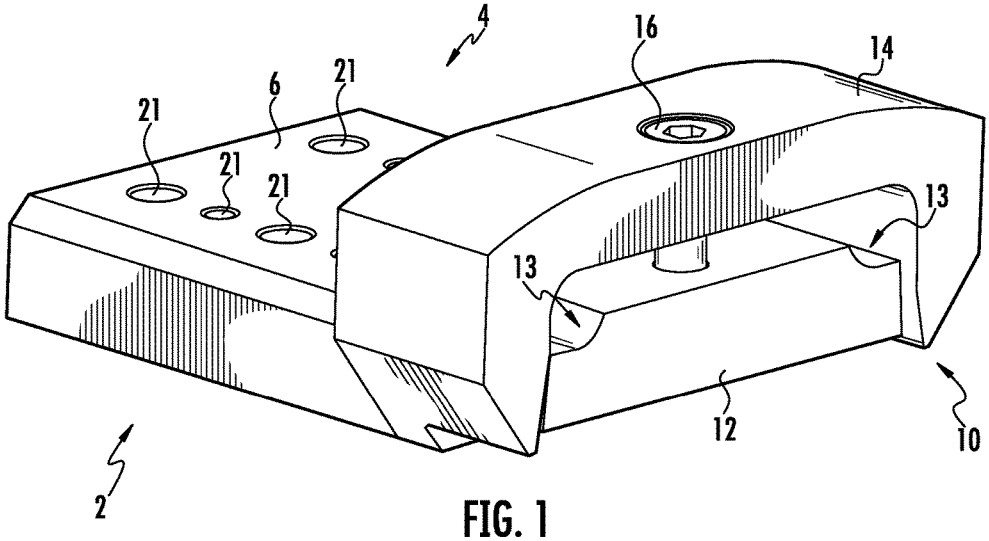
FIG. 1 shows a perspective view of a fixing module according to an exemplary embodiment of the invention.

FIG. 1 shows a perspective view of a fixing module 2 according to an exemplary embodiment of the invention.

The fixing module 2 has a pallet side 4, which is shown on the left side of FIG. 1 and comprises a box-shaped connection portion 6. The connection portion 6 is configured to be inserted into a corresponding receiving space of a pallet (not shown in FIG. 1) for fixing the fixing module 2 in a non-rotatable manner to the pallet.

The connection portion 6 comprises a plurality of openings 21 which may receive screws or bolts (not shown) for securely fixing the connection portion 6 of the fixing module 2 to the pallet.

The fixing module 2 further comprises a pallet chain side 10 which is located opposite to the pallet side 4 and which is shown on the right side of FIG. 1. The pallet chain side 10 is configured for facing a pallet chain (not shown in FIG. 1) of the pallet conveyor.

The pallet chain side 10 comprises a bracket 14 which is U-shaped or V-shaped in particular with smooth tangent radii. The bracket 14 is securely connected to, or integrally formed with, the connection portion 6 with the opening of the bracket 14.

The fixing module 2 further comprises a securing element 12, in particular a clamping element, which is movably arranged within the U-shaped or V-shaped bracket 14. In FIG. 1 the clamping element has the configuration of a clamping plate. The securing element 12 is connected to the bracket 14 by means of a tightening element 16, e.g. a screw, which allows to press the securing element 12 against the central portion of the bracket 14 by tightening the tightening element 16.

Two recesses 13, which are configured for respectively receiving a fixing element protruding from the pallet chain (not shown), are formed on the upper side of the movable securing element 12 facing the bracket 14. As a result, the fixing module 2 can be non-rotatably fixed to the pallet chain by tightening the tightening element 16, thereby clamping the fixing elements protruding from the pallet chain between the securing element 12 and the bracket 14. This will be described in more detail further below with reference to FIGS. 5 and 6.

Although only one tightening element 16 is shown in FIG. 1, the skilled person will understand that a plurality of tightening elements 16 may be used, if considered appropriate.

Figure 2:
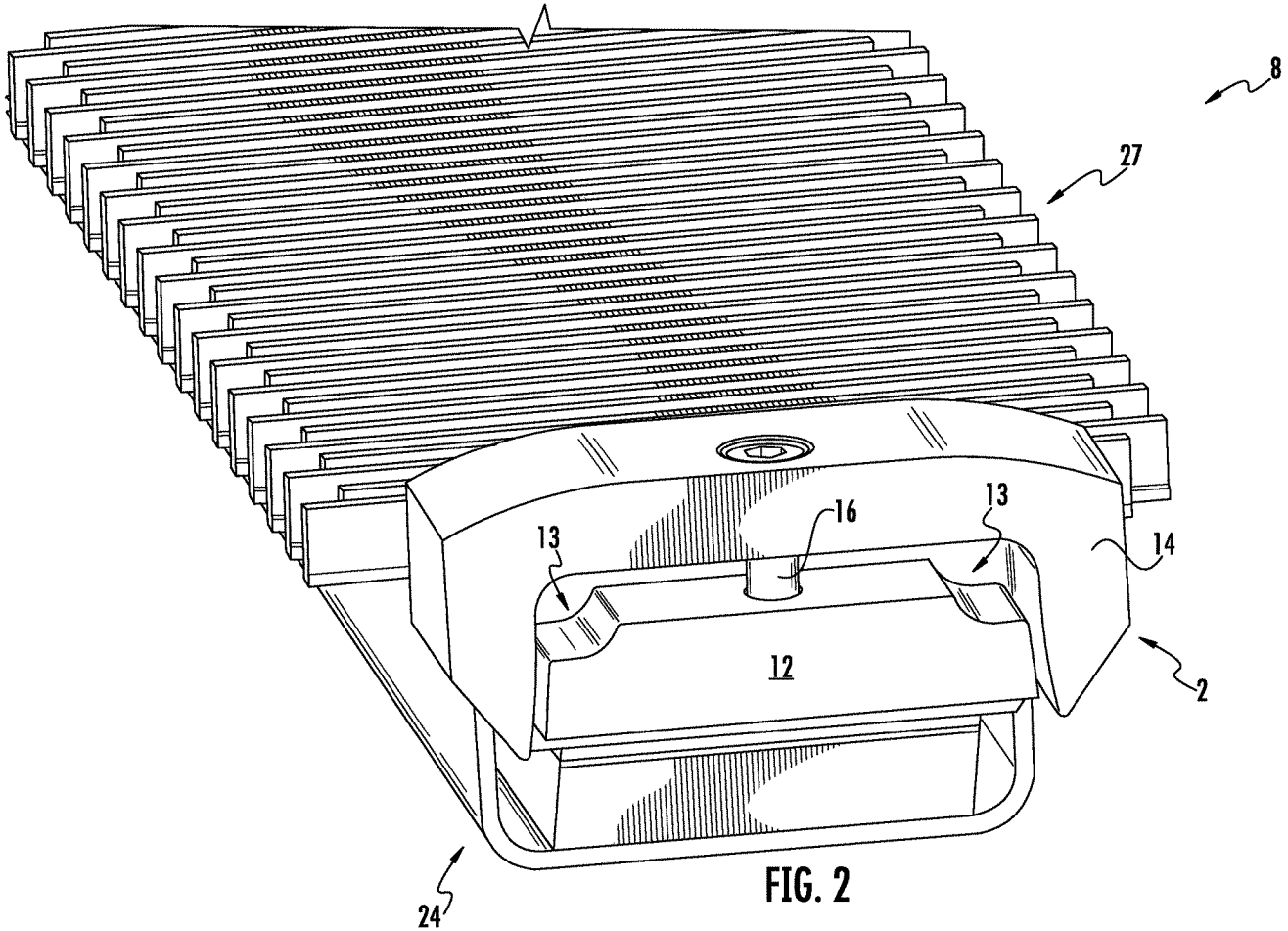
FIG. 2 shows the fixing module of FIG. 1 attached to a pallet of a pallet conveyor.

FIG. 2 shows the fixing module 2 shown in FIG. 1 attached to a pallet 8 of a pallet conveyor. The pallet 8 comprises a pallet carrier body 24 and a tread 27 which is installed on an upper side of the pallet carrier body 24.

Figure 3:
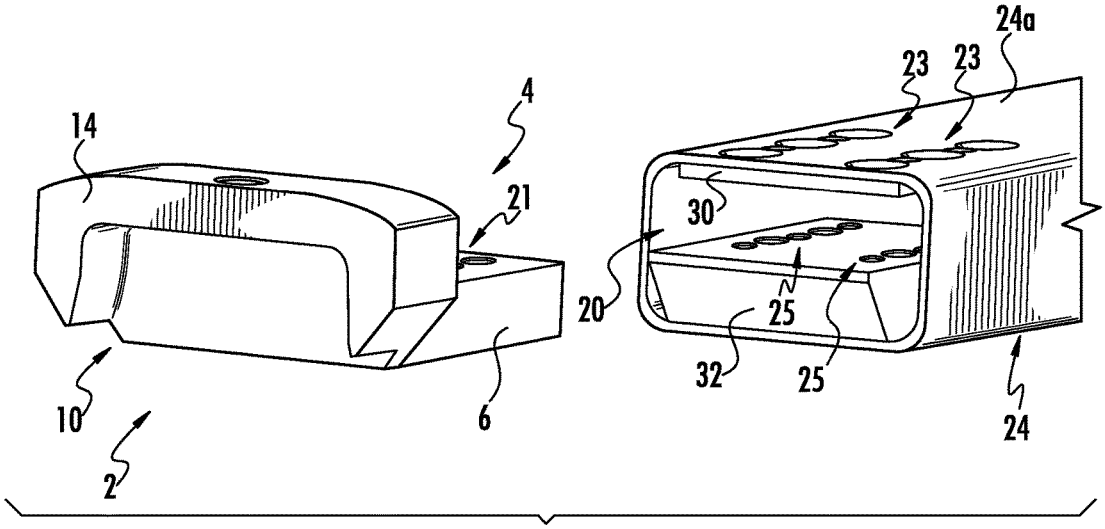
FIG. 3 shows a first embodiment of a pallet assembly comprising the fixing module, as it is depicted in FIGS. 1 and 2, and a first embodiment of a pallet.
Figure 4:
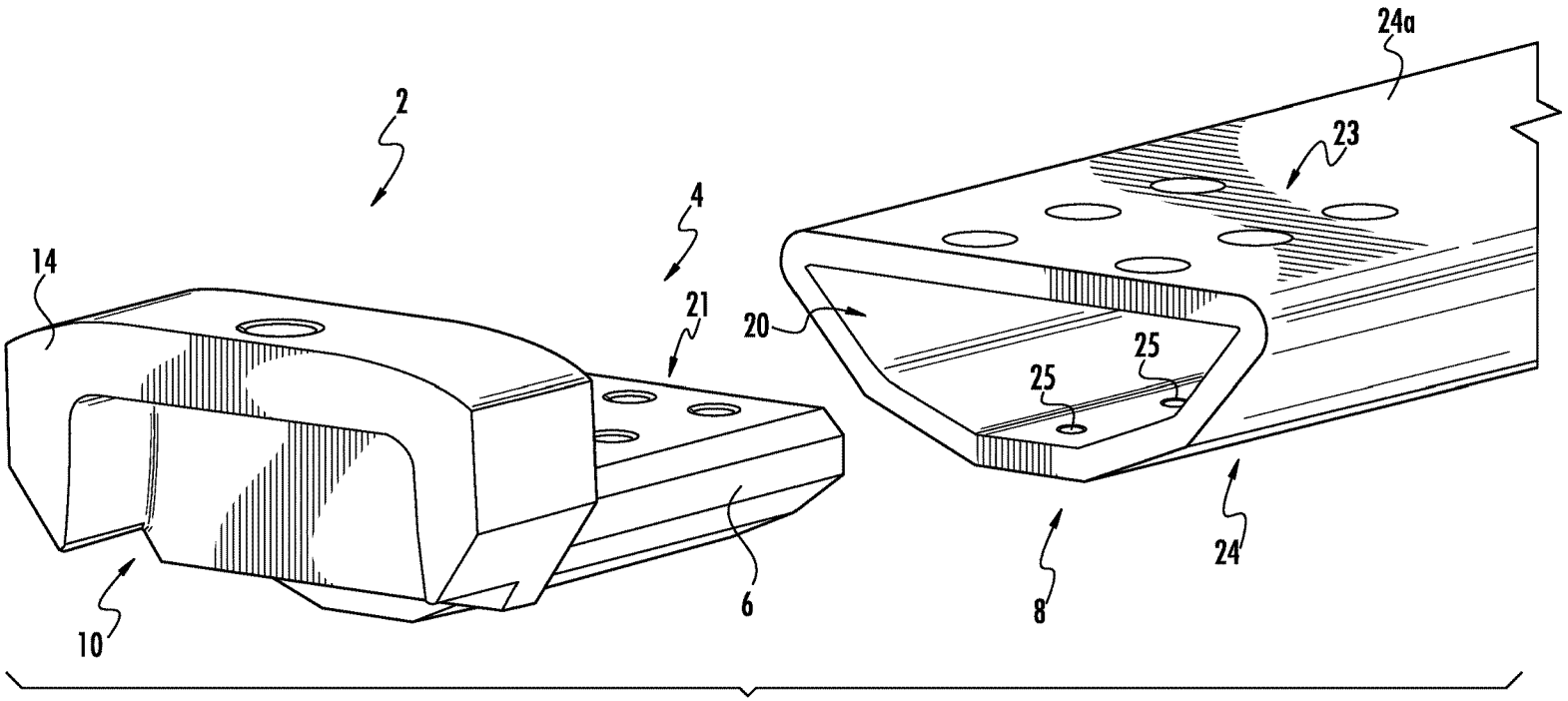
FIG. 4 shows a second embodiment of a pallet assembly comprising the fixing module, as it is depicted in FIGS. 1 and 2, and a second embodiment of a pallet.

The details of the connection between the fixing module 2 and the pallet 8 become more apparent from FIGS. 3 and 4.

FIG. 3 shows a pallet carrier body 24 provided by a box-shaped hollow profile with rounded corners. The upper portion 24*a* of the pallet carrier body 24 is configured for receiving and supporting a tread 27, which is not shown in FIG. 3. An additional plate 30 is attached to the upper portion 24*a* from below, i.e. from inside the hollow profile.

A connection block is 32 is provided inside the pallet carrier body 24 at its bottom. Between the upper side of the connection block 32 and the lower side of the additional plate 30 a receiving space 20 is formed. The receiving space 20 is configured for receiving the connection portion 6 of the fixing module 2.

Openings 23, 25 are formed within the upper portion 24*a*, the additional plate 30 and the connection block 32, respectively. These openings 23, 25 allow for securely fixing the connection portion 6 of the fixing module 2 to the pallet carrier body 24 by means of screws or bolts (not shown) extending through said openings 23, 25 and corresponding openings 21 formed within the connection portion 6 of the fixing module 2.

FIG. 4 illustrates an alternative embodiment, in which the hollow profile forming the pallet carrier body 24 has a tapered cross section. The connection portion 6 of the fixing module 2 is formed correspondingly allowing the fixing module 2 to be inserted into the pallet carrier body 24.

The additional features shown in FIG. 4 correspond to the respective features shown in FIG. 3 and are therefore not discussed in detail again.

Figure 4A:
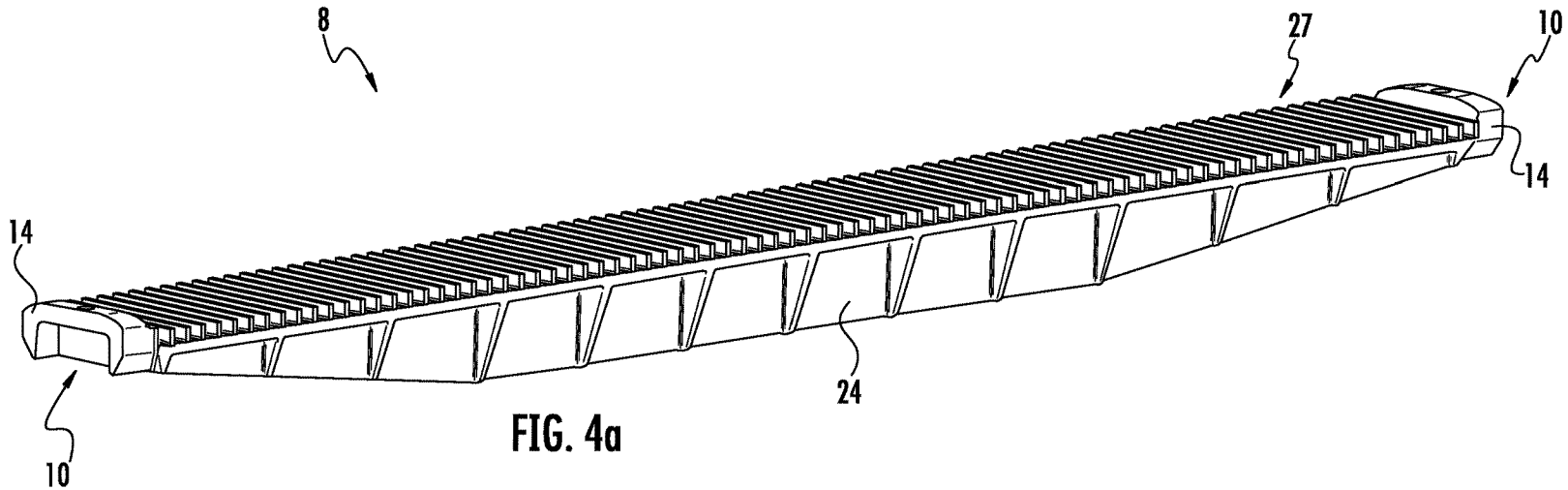
FIGS. 4*a* to 4*c* illustrate an embodiment in which the fixing module is formed integrally with the pallet.
Figure 4B:
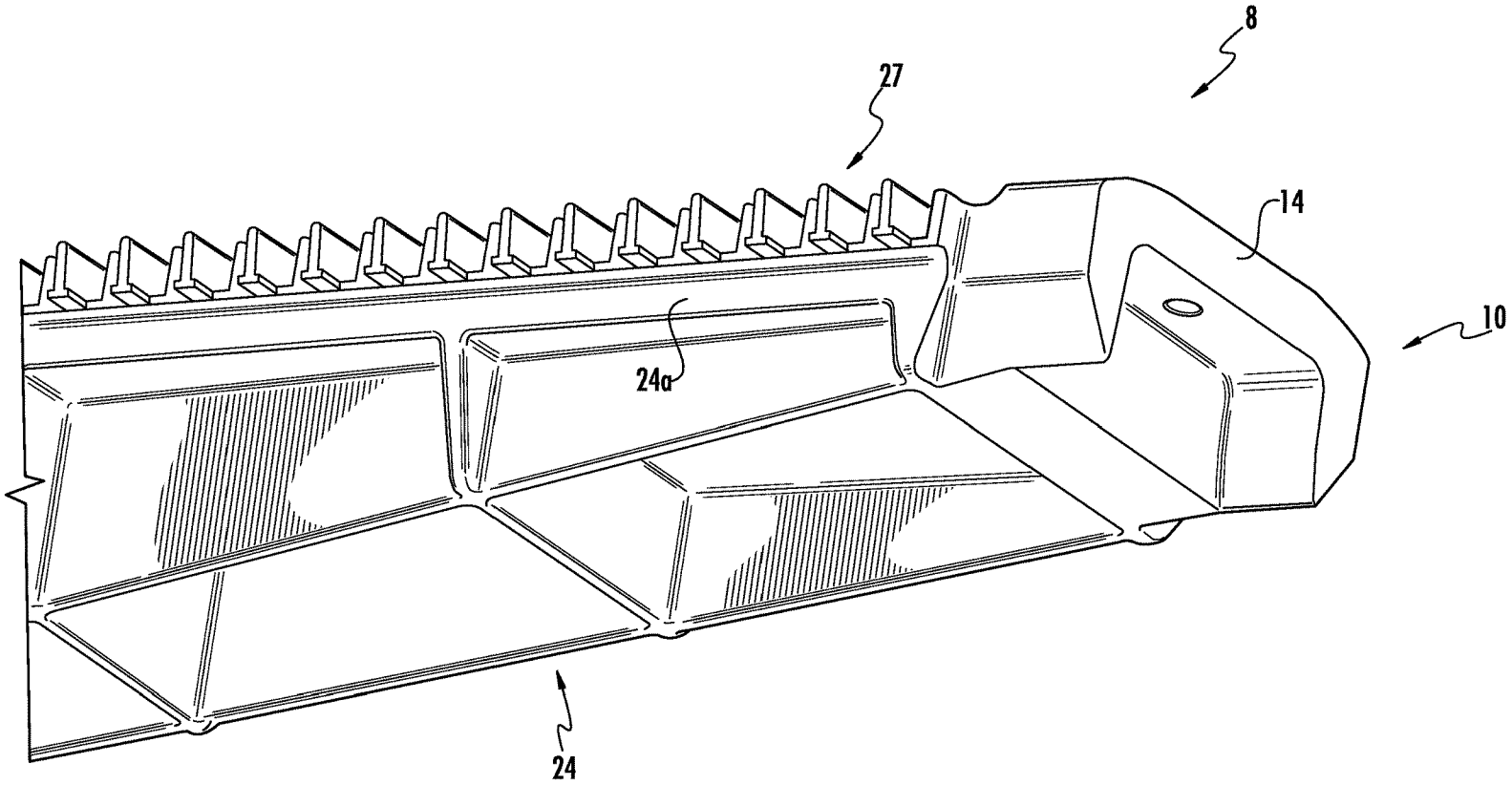
Figure 4C:
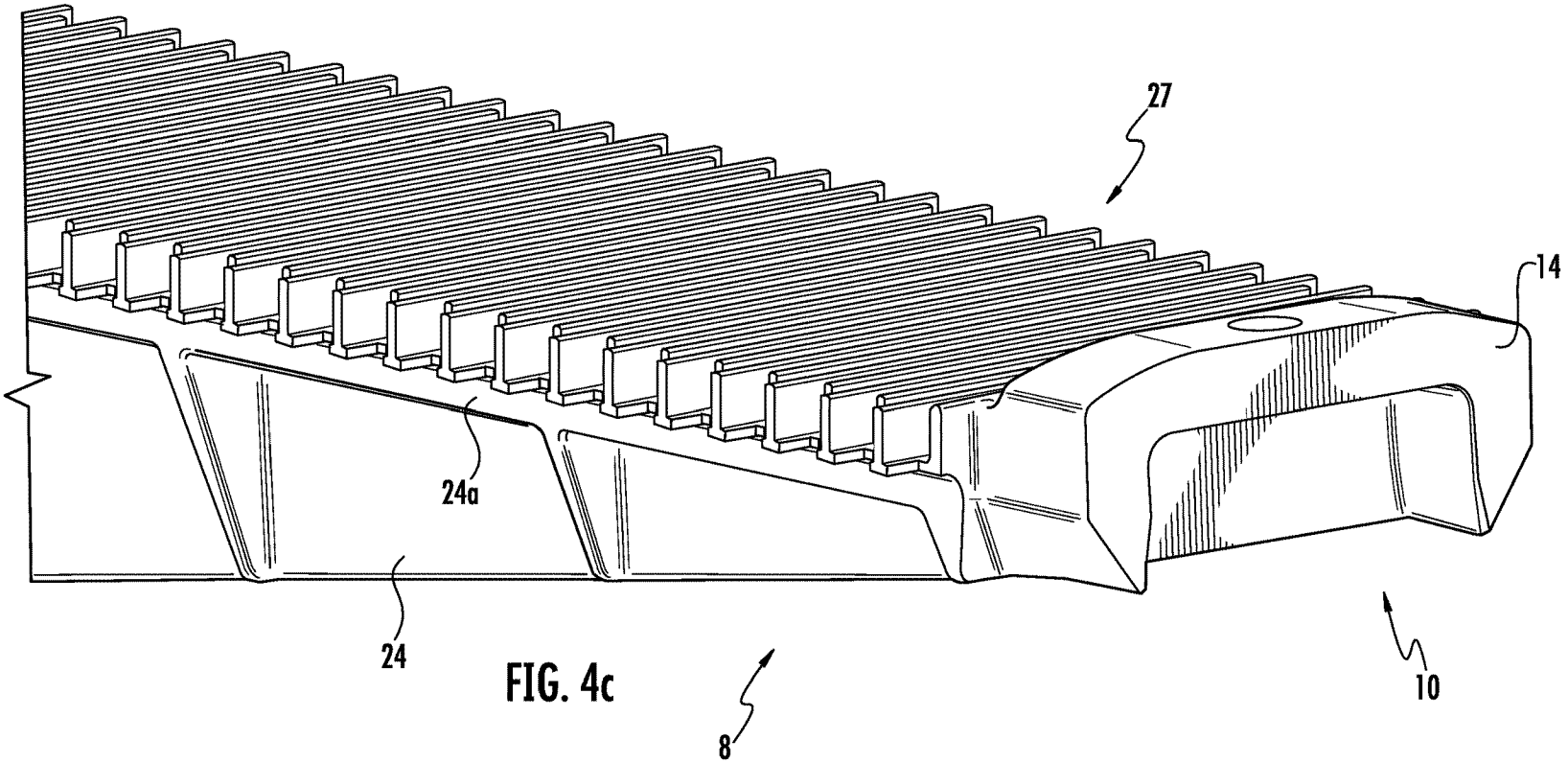

In an alternative embodiment, which is shown in FIGS. 4*a* to 4*c*, the fixing module 2 is formed integrally with the pallet 8. The fixing module 2 for example may be welded to the pallet 8. Alternatively, the fixing module 2 may be integrated into a cast pallet 8, e.g. a cast pallet 8 made of aluminum.

In the embodiment shown in FIGS. 4*a* to 4*c* the pallet carrier body 24 is formed with recesses for reducing the weight of the pallet 8. In alternative embodiments, which are not shown in the figures, the pallet carrier body 24 may have a grid or honeycomb structure including holes.

Figure 4D:
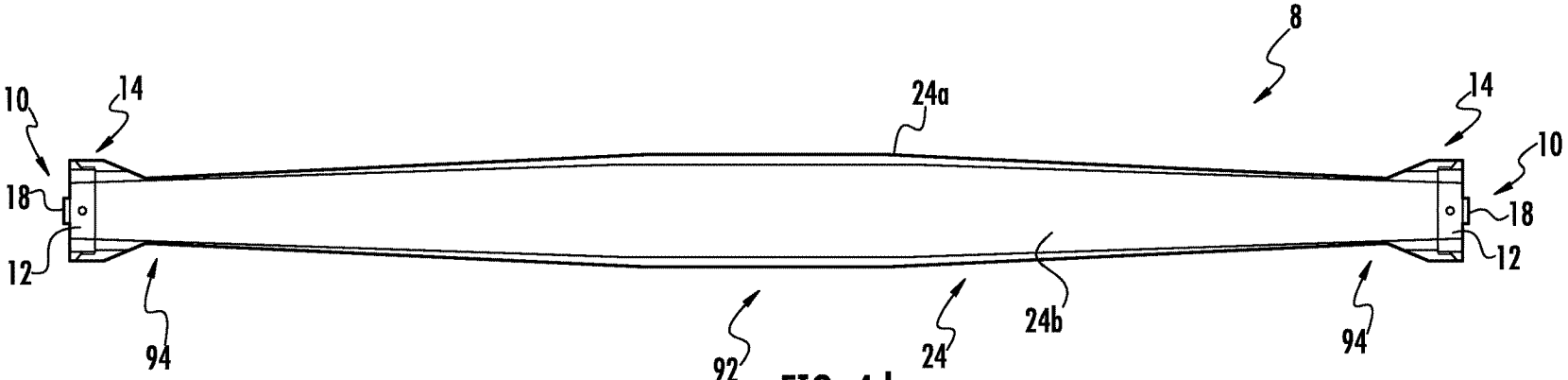
FIG. 4*d* shows a bottom view of a pallet having a non-constant cross section in a direction perpendicular to the conveying direction.

FIG. 4*d* shows a bottom view of a pallet 8 having a non-constant cross section in a direction perpendicular to the conveying direction. As depicted in FIG. 4*d*, the extension of the upper portion 24*a* as well as of the lower portion 24*b* of the pallet carrier body 24 in the conveying direction, which extends from the bottom to the top in FIG. 4*d*, varies from left to right, i.e. in a direction perpendicular to the conveying direction. The upper portion 24*a* and the lower portion 24*b* of the pallet carrier body 24 in particular have their largest extension at a central portion 92 of the pallet 8 and their shortest extension at lateral side portions 94 next to the brackets 14, respectively.

Alternatively, only one of the upper portion 24*a* and the lower portion 24*b* of pallet carrier body 24 may have a non-constant cross section. The varying cross sections may have different shapes than that shown in FIG. 4*d*. Employing a non-constant cross section may help to reduce the weight of the pallet 8.

Figure 5:
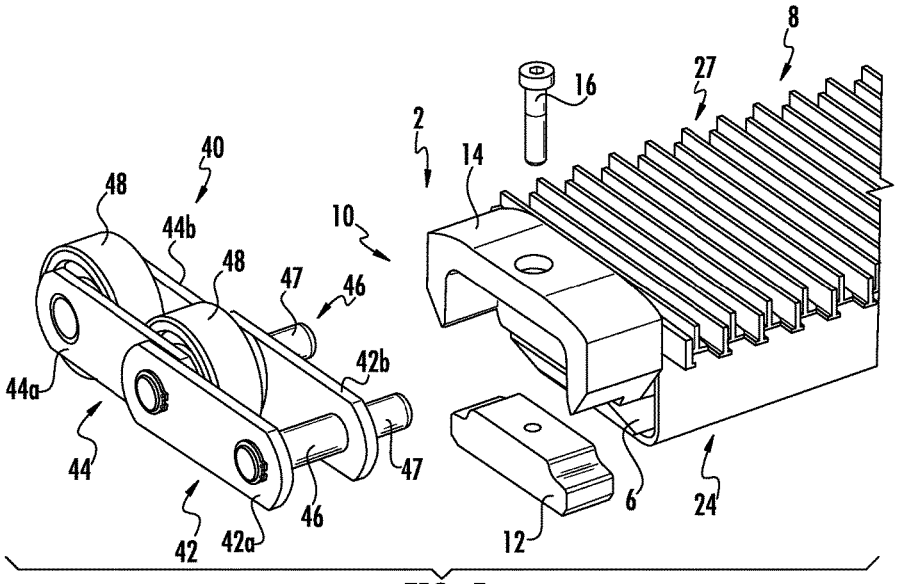
FIG. 5 illustrates the connection of the fixing module to a pallet chain according to a first embodiment.
Figure 6:
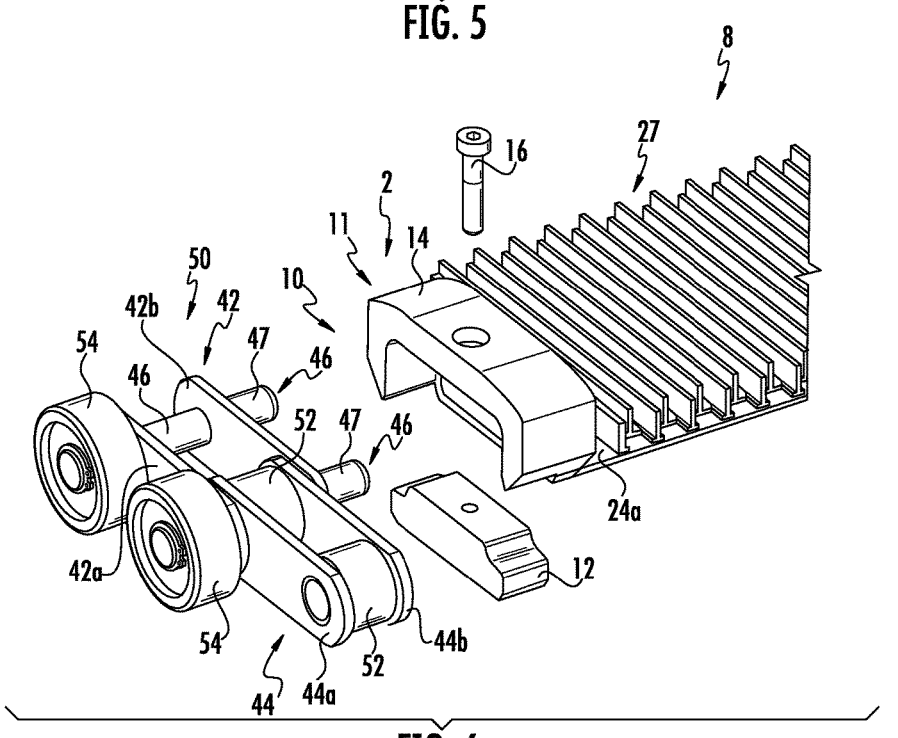
FIG. 6 illustrates the connection of the fixing module to a pallet chain according to a second embodiment.

FIGS. 5 and 6 illustrate the connection of the pallet chain side 10 of the fixing module 2 to a pallet chain 40, 50, respectively.

FIG. 5 shows a portion of a pallet chain 40 according to an embodiment comprising two pallet chain links 42, 44, in particular an outer pallet chain link 42 and an inner pallet chain link 44 which are connected to each other by a respective pallet chain link bolt 46. Each pallet chain link 42, 44 is formed by a pair of pallet chain link plates 42*a*, 42*b*, 44*a*, 44*b* facing each other and forming a gap in between. On the side facing the pallet 8, the pallet chain link bolts 46 protrude from the pallet chain links 42, 44 towards the pallet 8. The protruding portions 47 of the pallet chain link bolts 46 act as fixing elements which are configured to be fixed to the pallet 8 by the fixing module 2.

Pallet chain rollers 48, which are supported by the pallet chain link bolts 46, are arranged in the gaps provided between the pallet chain link plates 42*a*, 42*b*, 44*a*, 44*b*.

The pallet chain rollers 48 are configured for engaging a drive sprocket (not shown). In the embodiment shown in FIG. 5, the pallet chain rollers 48 are also configured for acting as pallet rollers supporting the weight of the pallet chain 40 and the pallets 8 on a corresponding guide rail, which is not shown in the figures.

For fixing a pallet 8 to the pallet chain 40, the protruding portions 47 of the pallet chain link bolts 46 are inserted into the U-shaped/V-shaped opening formed by the bracket 14 of the fixing module 2. In a following step, the movable securing element 12 is attached from below and clamped against the bracket 14 by tightening the tightening element 16. As a result, the protruding portions 47 of the pallet chain link bolts 46 are securely clamped between the movable securing element 12 and the bracket 14 of the fixing module 2 thereby securely fixing the pallet 8 to a pallet chain link 42, 44 of the pallet chain 40.

In FIG. 5, two pallet chain link bolts 46 assigned to a same outer pallet chain link 42 are used for fixing the pallet chain 40 to the fixing module 2. Thereby, the pallet 8 is non-rotatably fixed with respect to said outer pallet chain link 42. Similarly, in case two pallet chain link bolts 46 assigned to a same inner pallet chain link 44 are fixed to the fixing module 2, the pallet 8 can be fixed non-rotatably with respect to an inner pallet chain link 44. Either construction is possible.

FIG. 6 illustrates another embodiment. According to the embodiment shown in FIG. 6, the bracket 14 of the fixing module 2 is integrally formed with, or fixed to, the upper portion 24*a* of the pallet 8, e.g. by welding, thereby providing a fixing portion 11 of the pallet 8.

The embodiment of the pallet chain 50 shown in FIG. 6 differs from the embodiment of the pallet chain 40 shown in FIG. 5 in that it comprises pallet rollers 54, in addition to the pallet chain rollers 52 arranged in the gaps formed within the pallet chain links 42, 44 of the pallet chain 50. The pallet rollers 54 are provided laterally outside the pallet chain links 42, 44 on the side opposite to the pallet 8. The pallet rollers 54 are supported by the pallet chain link bolts 46 which protrude from the pallet chain links 42, 44 on the side facing away from the pallet 8 as well such as to form supporting portions for the pallet rollers 54. In an alternative embodiment, the pallet rollers 54 may be located at the opposite side facing the pallet 8. In such a configuration the bending stress acting on the pallet chain link bolts 46 is reduced.

The pallet chain rollers 52 are configured for engagement with a corresponding drive and/or turnaround element, e.g. a sprocket (not shown). The pallet rollers 54 are configured for supporting the pallet chain 50 and in particular the weight of the pallets 8 and a load on said pallet 8 on corresponding guide rails, which are not shown in the figures. In order to enhance the comfort of the passengers, the pallet rollers 54 may be made from a softer/more elastic material than the pallet chain rollers 52. A hard material may be used for the pallet chain rollers 52 in order to reduce their wear and increase their lifetime.

Figure 7:
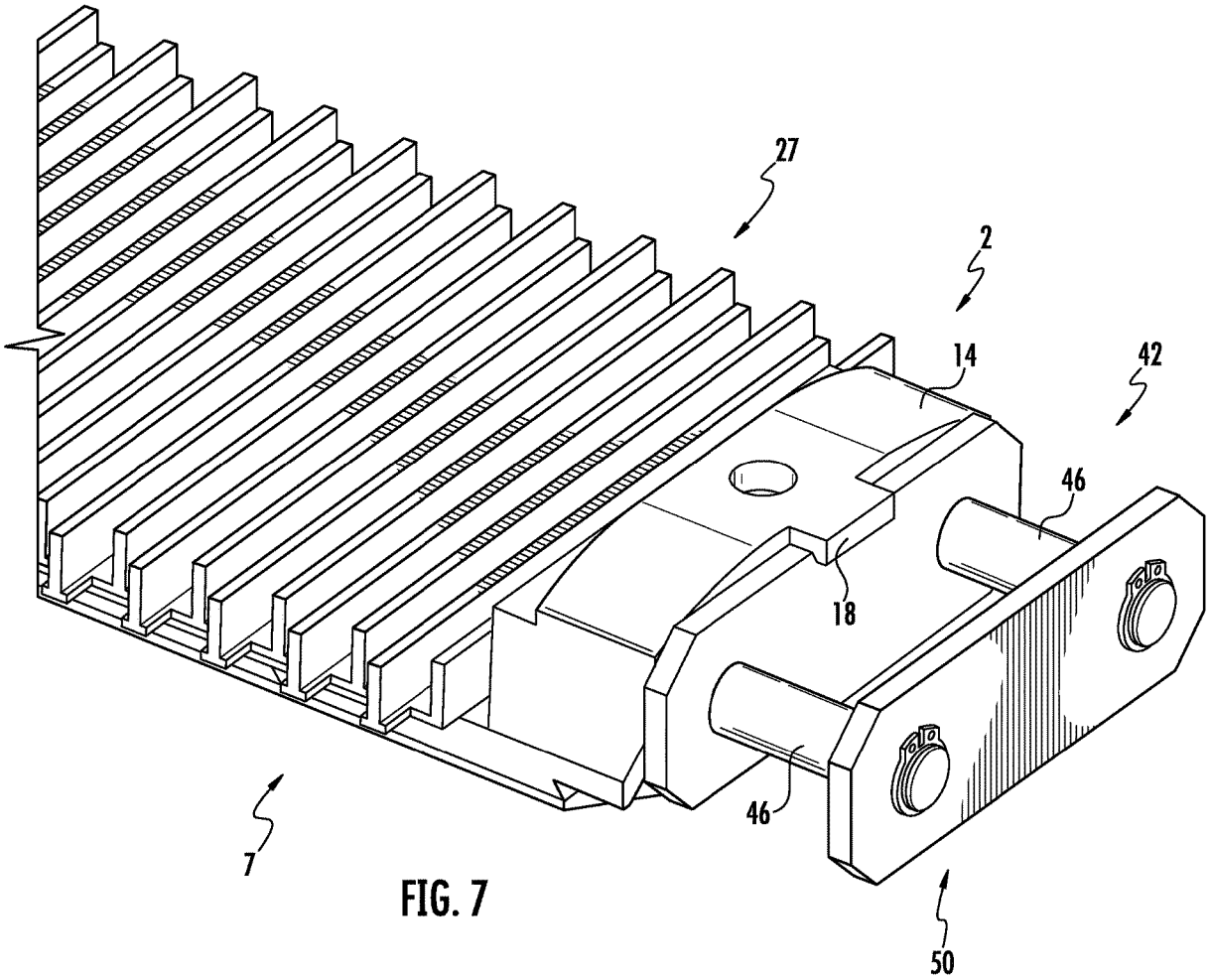
FIG. 7 shows an embodiment comprising an alignment protrusion.

FIG. 7 shows a further embodiment, in which an alignment protrusion 18 is formed at the side of the bracket 14 of the fixing module 2 facing the pallet chain 50.

Optionally, one of the pallet chain link plates of the pallet chain link 42 may be formed with a corresponding cut-out which is configured for receiving the alignment protrusion 18.

The alignment protrusion 18 facilitates a precise positioning of the pallet 8 with respect to the pallet chain link 42. Exact positioning of the pallet 8 with respect to the pallet chain link 42 is beneficial as the pallets 8 define the distance between the two pallets chains 50 provided on both sides of the conveyor. In order to secure a smooth entry of the pallets and treads into comb plates provided at the landing zones, said distance between the pallets chains 50 should be kept as constant as possible over the whole length of the conveyor.

Figure 8:
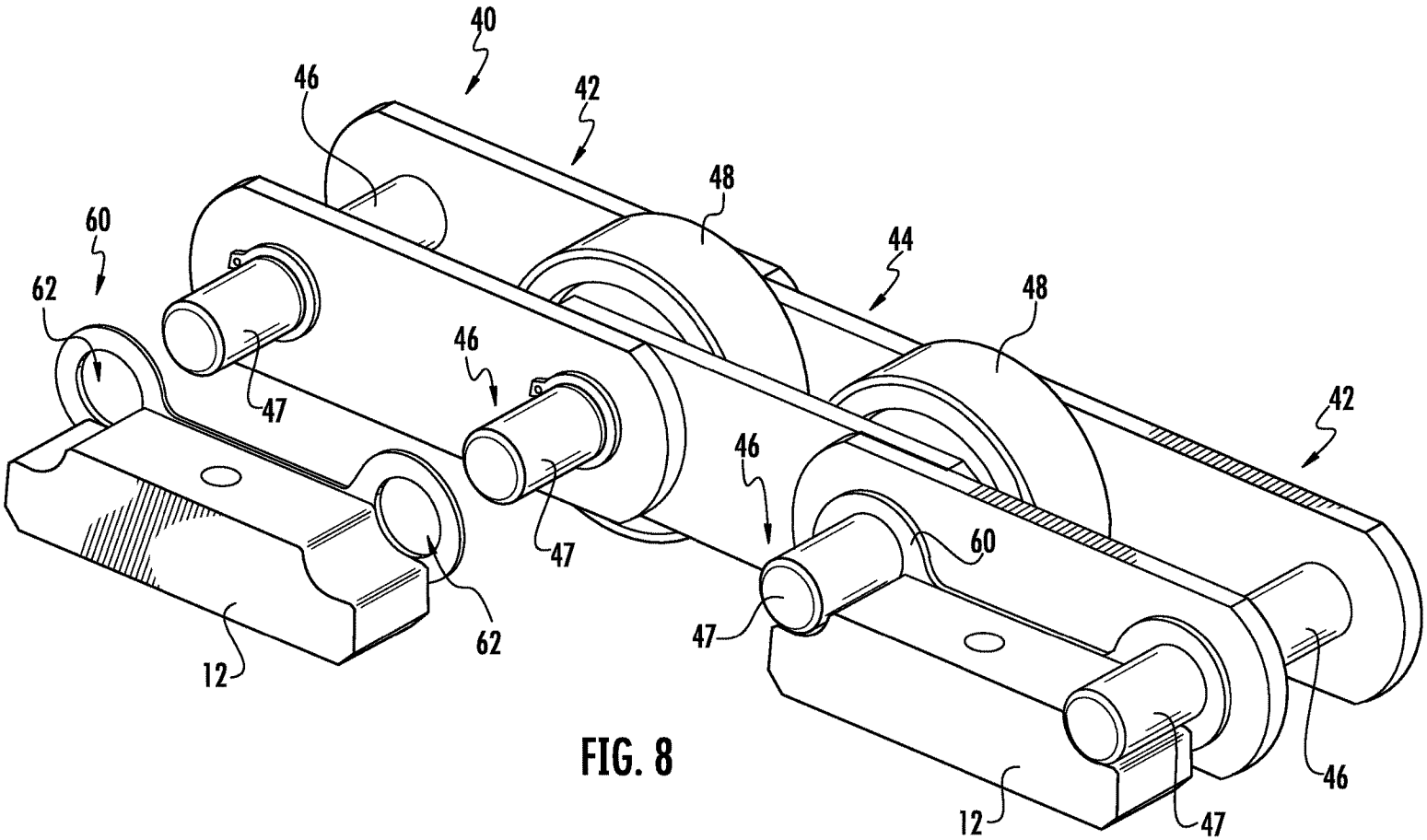
FIG. 8 illustrates a securing element comprising an additional installation plate.
Figure 9:
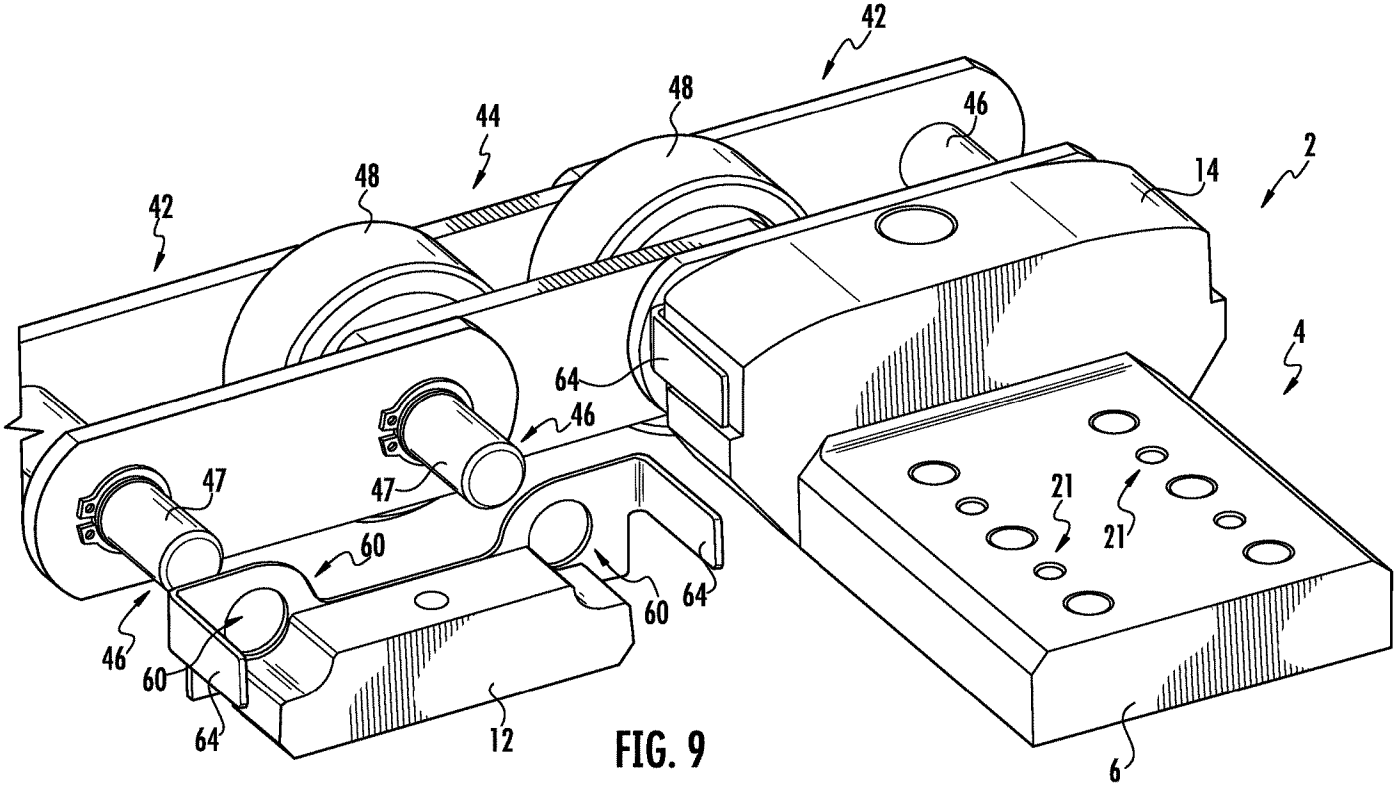
FIG. 9 illustrates a securing element comprising an installation plate and retaining flaps.

FIGS. 8 and 9 illustrate an additional optional feature facilitating a secure connection between the pallet chain 40 and the pallets 8 using the fixing module 2, particularly during the installation of a pallet conveyor and for maintenance purposes.

In this embodiment the securing element 12 comprises an additional installation plate 60. The installation plate 60 in particular may be provided at the side of the securing element 12 facing the pallet chain 40, as it is shown in FIG. 8. The installation plate 60 is provided with two openings 62. Each of the openings 62 has a diameter which is slightly larger than the diameter of the protruding portions 47 of the pallet chain link bolts 46. In consequence, the openings 62 allow to loosely hang the securing elements 12 onto the protruding portions 47 of the pallet chain link bolts 46 in preparation of the installation, as it is shown on the right side of FIG. 8. In the next step, which is not shown in the figures, the bracket 14 of the fixing module 2 (not shown in FIG. 8) is added from above and the securing element 12 is moved towards the bracket 14 clamping the protruding portions 47 of the pallet chain link bolts 46 by inserting and tightening the tightening element 16, as it has been described before.

In addition, in case the tightening element 16 is untightened for removing a pallet 8 from the pallet chain 40, the installation plate 60 will prevent the securing element 12 from falling down. Instead, the securing element 12 will remain at the pallet chain 40 supported by the protruding portions 47 of the pallet chain link bolts 46, as it is shown on the right side of FIG. 8.

In the embodiment shown in FIG. 9, the installation plate 60 additionally comprises two retaining flaps 64 which are configured for embracing the bracket 14 in the installed position, as shown on the right side of FIG. 9. The retaining flaps 64 avoid that the pallet 8 loses its connection with the pallet chain 50 in case the tightening element 16 breaks or loosens. The retaining flaps 64 further facilitate the detection of loose or broken clamping screws 16 as the define/lock the position of the bracket 14 and securing element 12 on the protruding portions 47 of the pallet chain link bolts 46.

In the following, exemplary embodiments of pallet conveyors 70, 80 in which fixing modules 2 and/or pallets 8 according to exemplary embodiments of the invention may be used, will be described with respect to the corresponding figures.

Figure 10:
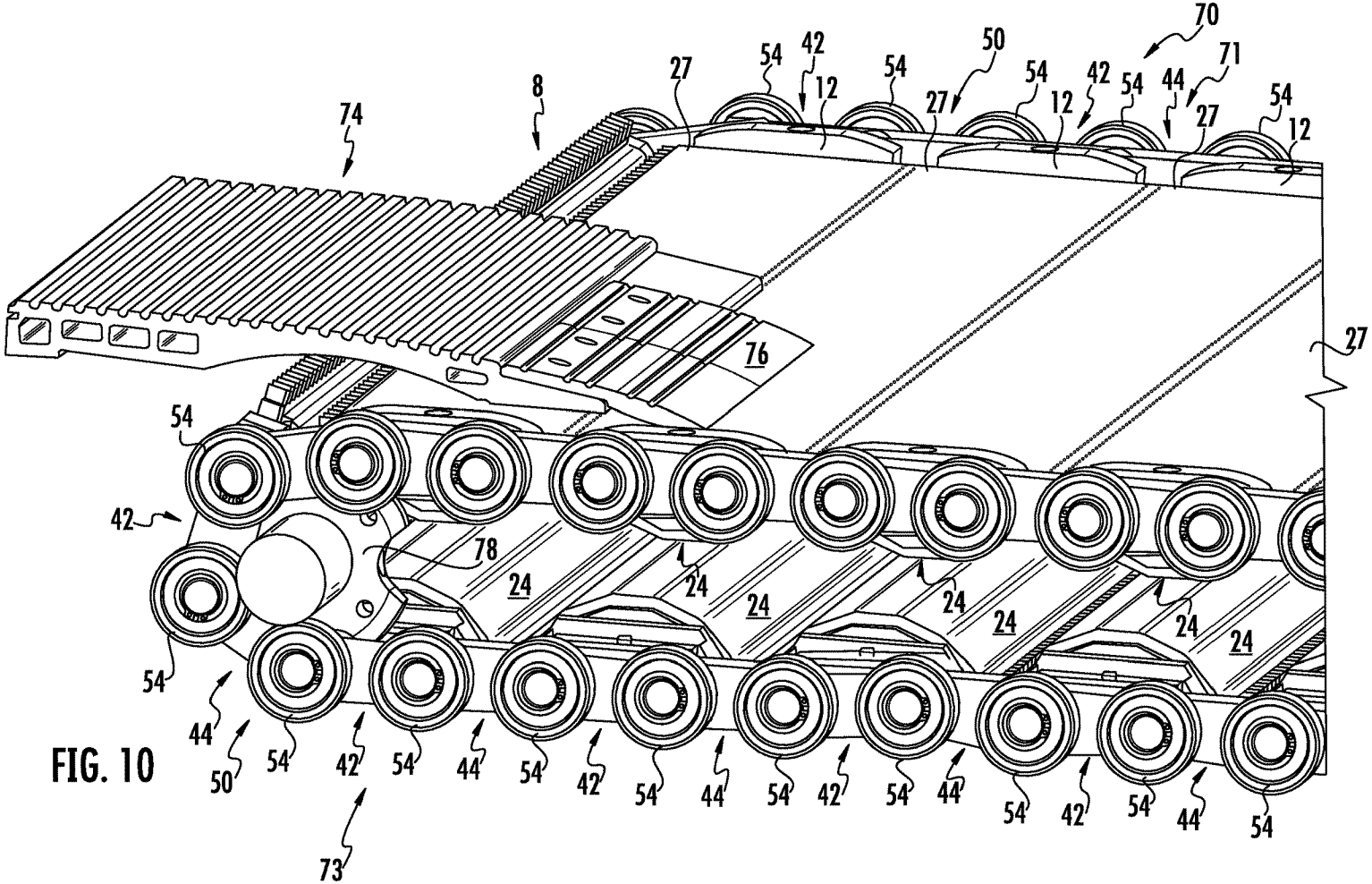
FIG. 10 shows a perspective view of a pallet conveyor according to a first exemplary embodiment.
Figure 11:
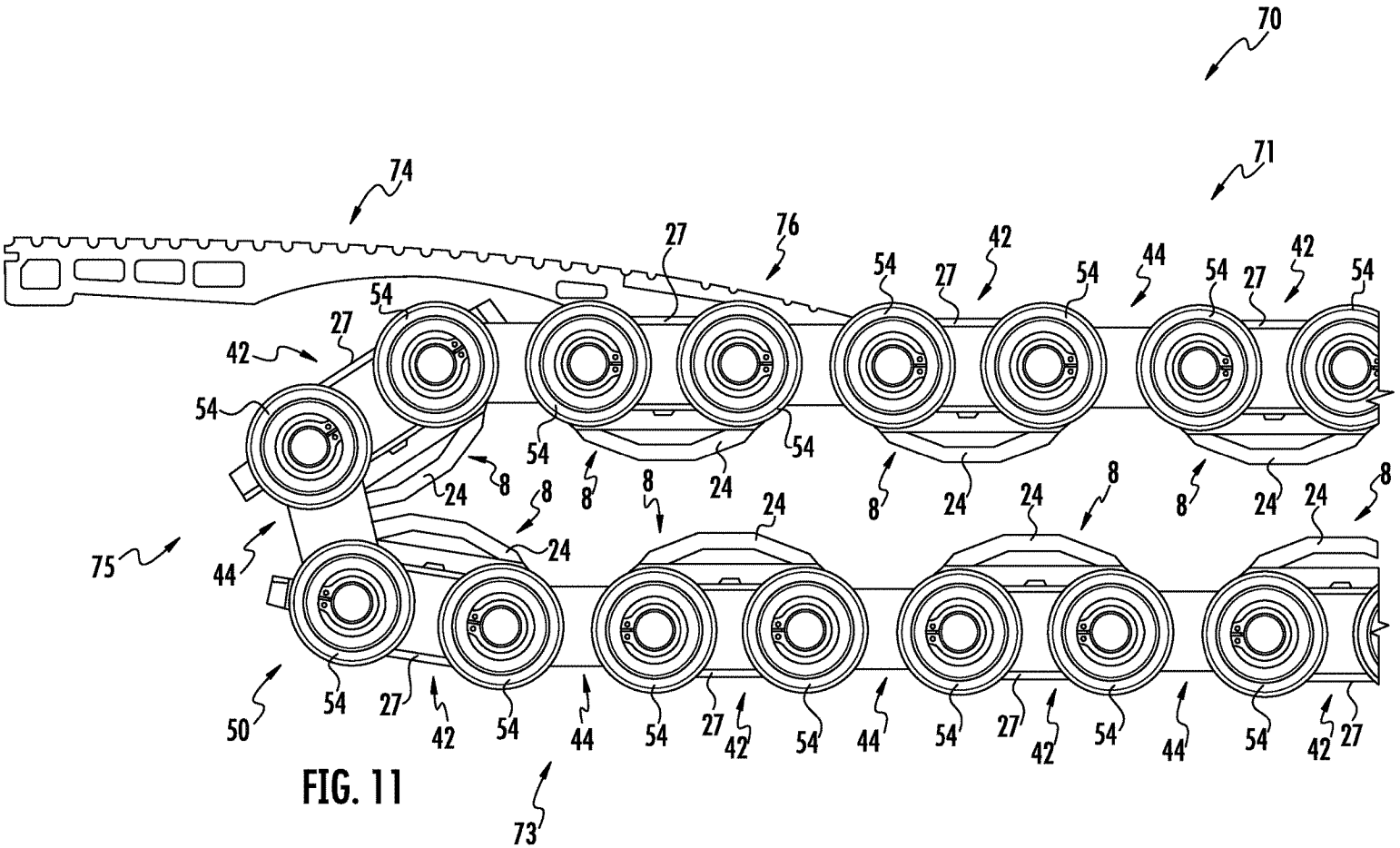
FIG. 11 shows a side view of the pallet conveyor according to the first exemplary embodiment.

FIG. 10 shows a perspective view and FIG. 11 shows a side view of a landing portion of a pallet conveyor 70 according to a first exemplary embodiment.

The pallet conveyor 70, which in particular may be a people conveyor such as a moving walkway, comprises a plurality of movable pallets 8. The pallets 8 are connected to each other forming an endless pallet band which is movable in a conveying direction. In the embodiment shown in FIGS. 10 and 11, consecutive pallets 8 are connected to each other by means of two pallet chains 50 extending on both lateral sides of the pallets 8 for forming the endless pallet band. The pallet chains 50 are driven by a drive (not shown in the Figures), e.g. via a sprocket 78, and drivingly coupled to the pallet band, such as to drive the pallet band in the conveying direction.

The pallet conveyor 70 in particular comprises an upper transportation portion 71 and a lower return portion 73. The pallets 8 in the upper transportation portion 71 may move horizontally from the right side to the left side in FIGS. 10 and 11 or in the opposite direction from the left side to the right side.

Although the pallet conveyor 70 shown in FIGS. 10 and 11 extends horizontally, it also may be arranged in an inclined orientation for allowing transportation between different levels of height.

Each of the pallet chains 50 comprises a plurality of pallet chain links 42, 44, in particular alternately inner pallet chain links 44 and outer pallet chain links 42. Each of the pallet chain links 42, 44 includes a pair of opposite pallet chain link plates 42*a*, 42*b*; 44*a*, 44*b* (cf. FIG. 6). The pair of pallet chain link plates 44*a*, 44*b* of each inner pallet chain link 44 is sandwiched in between the pairs of pallet chain link plates 42*a*, 42*b* of its two adjacent outer pallet chain links 42. The pitch of the pallet chains 50 is smaller than the pitch of the pallet band, i.e. the number of pallet chain links 42, 44 in each of the pallet chains 50 is larger than the number of pallets 8 in the corresponding pallet band, although the pallet chain links 42, 44 follow the same endless path as the pallets 8.

In the exemplary embodiment shown in FIGS. 10 and 11, the pallet chains 50 in particular include twice as much pallet chain links 42, 44 as the corresponding pallet band includes pallets 8, respectively. The pallets 8 are non-rotatably connected to every second pallet chain link 42, 44, in particular to every outer pallet chain link 42. The outer pallet chain links 42 form first pallet chain links which are non-rotatably connected to one of the pallets 8. Thus, there is no relative movement between each of the pallets 8 and the first pallet chain link to which it is connected. The remaining other pallet chain links (in the embodiment of FIGS. 10 and 11, the inner pallet chain links 44) are not directly connected to any pallet 8. Rather, these other pallet chain links form second pallet chain links connecting two adjacent first pallet chain links with each other and simultaneously connecting two adjacent pallets 8 with each other to form the pallet band.

Figure 14:
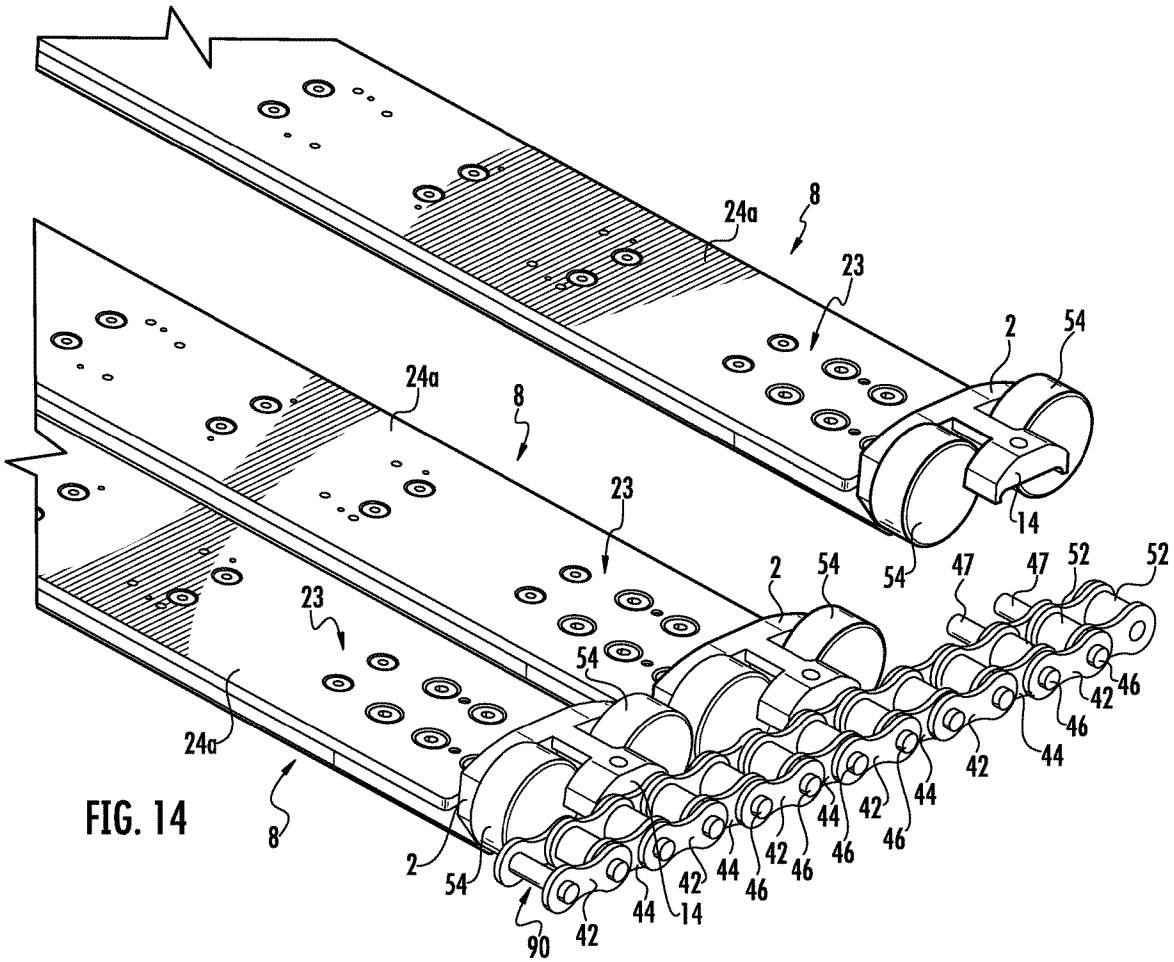
FIG. 14 shows a perspective view of a pallet conveyor according to a third exemplary embodiment.
Figure 15:
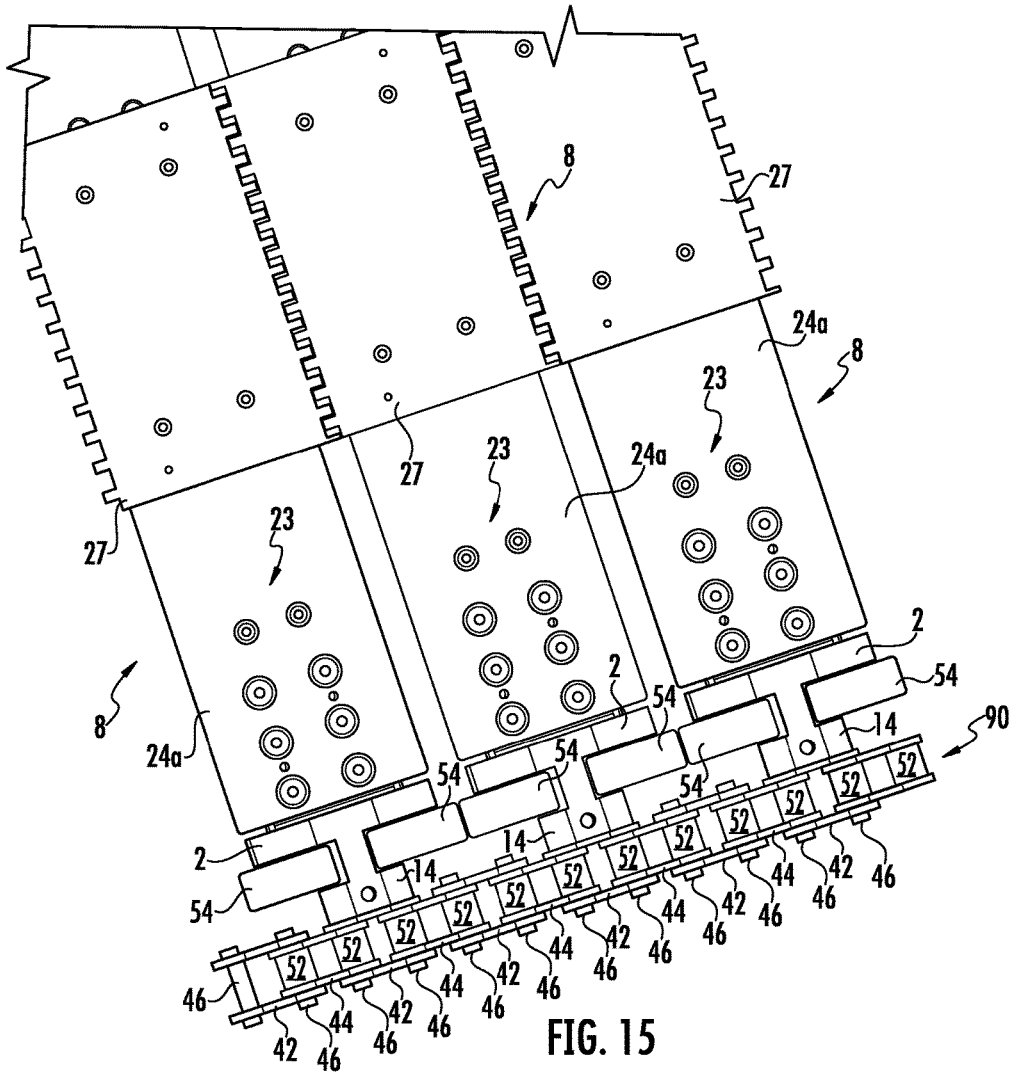
FIG. 15 shows a top view of the pallet conveyor according to the third exemplary embodiment.

While in the embodiment of FIGS. 10 and 11 each of the outer pallet chain links 42 forms a first pallet chain link, configurations are conceivable where only part of the outer pallet chain links 42 form first pallet chain links (e.g. only every second of the outer pallet chain links 42 forms a first pallet chain link, as shown in FIGS. 14 and 15).

In case there is an uneven number of pallet chain links 42, 44 per pallet, offset chain links may be used. An offset chain link comprises a first side, which is configured to be connected to an inner chain link 42, and a second side, which is configured to be connected to an outer chain link 42. The distance between the plates of the offset chain link at the first side corresponds to the distance between the pallet chain link plates 42*a*, 42*b* of an outer chain link 42, and the distance between the plates of the offset chain link at the second side corresponds to the distance between the pallet chain link plates 44*a*, 44*b* of an inner chain link 44. A pallet chain 50 comprising offset chain links allows to connect the fixing modules 2/pallets to outer pallet chain links 42 even if there is an uneven number of pallet chain links 42, 44 per pallet.

Figure 11A:
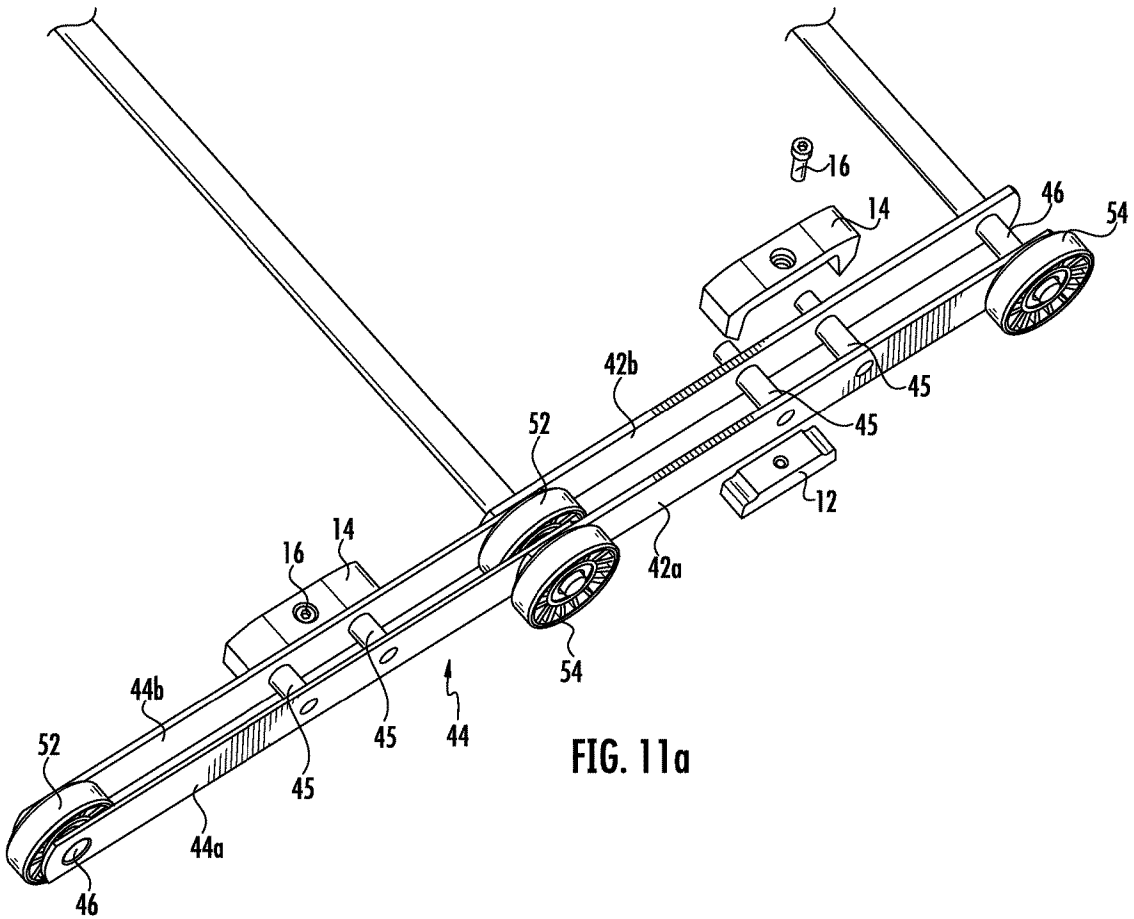
FIG. 11*a* illustrates an alternative configuration in which the fixing modules are fixed to intermediate bolts.

FIG. 11*a* illustrates an alternative configuration. If the pallet chain links 42, 44 are long enough so that there is enough space between adjacent pallet chain link bolts 46, intermediate bolts 45 may be added to the pallet chain links 42, 44 in between said adjacent pallet chain link bolts 46. The fixing modules 2/pallets 8 may be fixed to said intermediate bolts 45. In this case, appropriate recesses for accommodating the intermediate bolts 45 are provided within the sprocket 78 and/or linear drives are used for driving the pallet chains 50.

The pallets 8 are in particular non-rotatably connected to the outer pallet chain links 42 as it has been described before.

Treads 27 are attached to the pallets 8 for providing a moving conveying plane in the upper transportation portion 71 of the pallet conveyor 70. Persons using the pallet conveyor 70 stand on the treads 27 in the transportation portion 71 when using the pallet conveyor 70.

In order to avoid gaps within said conveying plane in the transportation portion 71, the extension of each of the treads 27 in the conveying direction, i.e. the horizontal direction in FIGS. 10 and 11, is larger than the length of each of the pallet chain links 42, 44 in said conveying direction (in FIGS. 10 and 11: twice as large). As a result, each tread 27 covers the same distance in the conveying direction as a plurality of adjacent pallet chain links 42, 44 (in FIGS. 10 and 11 each tread 27 covers the same distance as two adjacent pallet chain links 42, 44).

The extension of each of the treads 27 in the conveying direction results in an overhang of the treads 27 with respect to a pallet carrier body 24 of the pallets 8. Said overhang may result in a tilting movement of the pallets 8 when a person is standing on a tread 27 when traveling in the transportation portion 71.

As one option to suppress such tilting movement, tension of the pallet chain 50 may be controlled in a suitable manner. Particularly, the pallet chain 50 may be biased, i.e. a tension force may be applied to the pallet chain 50. The tension force may be adjusted as high as required to sufficiently suppress tilting of the tread 27 when traveling in the transportation portion 71 and subject to a typical load. Additionally or alternatively, the tilting movement may be reduced by increasing the weight of each pallet 8.

Pallet rollers 54 are provided on the laterally outer side of each of the pallet chains 50, i.e. on the side of each pallet chain 50 which is opposite to the pallets 8. The pallet rollers 54 support the pallets 8 and the respective pallet chain 50 on guide rails (not shown in FIGS. 10 and 11) extending parallel to the pallet chain 50.

In the turnaround portions 75 (one of the turnaround portions 75 is shown on the left side of FIGS. 10 and 11) pallet chain rollers, which are arranged inside the pallet chain links 42, 44 and which are not visible in FIGS. 10 and 11, engage with the teeth of a turnaround sprocket 78 for transferring the pallet chain 50 from the upper transportation portion 71 into the lower return portion 73, and vice versa.

A corresponding turnaround sprocket 78 is arranged in an opposing second turnaround portion 75 of the pallet conveyor 70, which is not shown in the figures. The turnaround sprocket 78 in at least one of the turnaround portions 75 may be driven by a drive mechanism including a motor (not shown) for driving the pallet band of the pallet conveyor 70.

Alternatively or additionally a linear drive mechanism may be provided at least one position along the transportation portion 71 and/or the return portion 73.

The turnaround portion 75 of the pallet conveyor 70 is covered by a comb plate 74 including a comb 76. The comb 76 comprises a plurality of teeth which engage with corresponding teeth formed on top of the treads 27.

In the embodiment shown in FIGS. 10 and 11, the turnaround sprocket 78 comprises only five teeth. A turnaround sprocket 78 having a small number of teeth usually has a small diameter which results in a low height of the turnaround portion 75.

The tread 27 of each pallet 8 is attached to the pallet carrier body 24 of the pallet 8. In order to avoid that the pallet carrier bodies 24 of the pallets 8 interfere with each other in the turnaround portions 75, the pallet carrier bodies 24 have a tapered cross section with a broad side of the tapered cross section facing towards the tread 27 and a narrow side of the tapered cross section being most distant from the tread 27.

Such a tapered cross section of the pallet carrier bodies 24 allows for a small turnaround radius in the turnaround portions 75, as it is illustrated in particular in FIG. 11. The cross sections of the pallet carrier bodies 24 may have various shapes, which in particular may include trapezoidal or triangular cross sections. The cross sections may but do not need to be constant in a direction perpendicular to the conveying direction. Some examples for possible cross sections of the pallets 8 are discussed further below with reference to FIGS. 16 to 19.

Each of the pallets 8 is non-rotatably connected to a respective one of the pallet chain links (in the embodiment shown in FIGS. 10 and 11: an outer chain link 42). Hence, the pallets 8 can be guided by the guiding mechanism of the pallet chain 50 throughout the endless path followed by the pallet chain 50 and the pallet band.

Particularly, there is no need for providing an additional guiding system for the pallets 8 in the turnaround portion 75. As the pallets 8 are connected with each other by one, or a plurality of, second pallet chain links (in the embodiment of FIGS. 10 and 11: an inner chain link 44), the pallet band is flexible enough to follow very narrow turnaround diameters when traveling in the turnaround sections. This simplifies the construction, installation and maintenance of the pallet conveyor 70. A very compact configuration of the turnaround sections 75 is achievable using such configuration. E.g. sprockets with only a few number of teeth (e.g. a sprocket with only 5 teeth as shown in FIG. 1) having a small diameter, may be used. Therefore, only a very shallow pit is required in the turnaround sections 75. This configuration further enhances its operational reliability, as malfunctions, which may be caused by an additional guiding system for the pallets 8 in the turnaround sections 75, are avoided.

Figure 12:
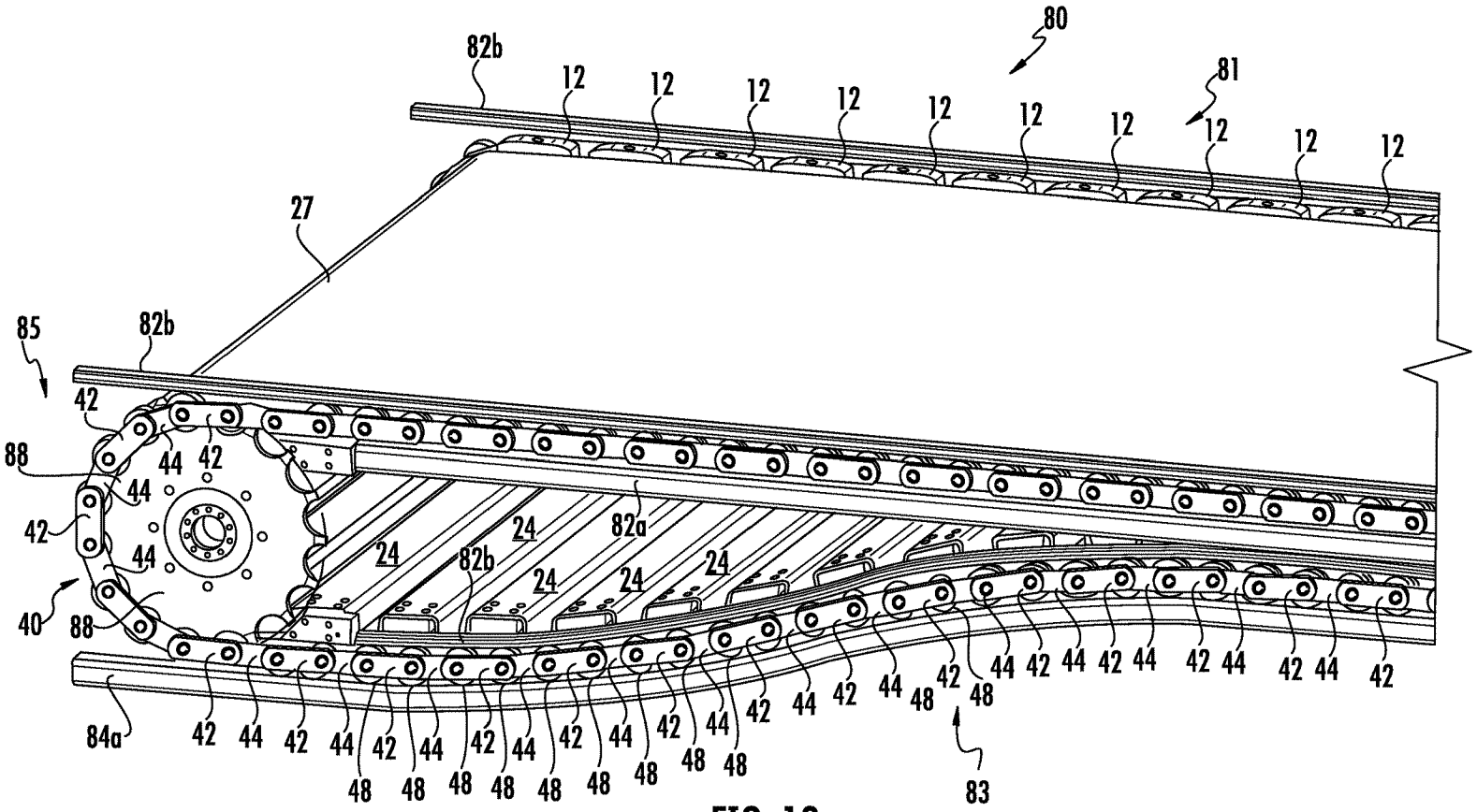
FIG. 12 shows a perspective view of a pallet conveyor according to a second exemplary embodiment.
Figure 13:
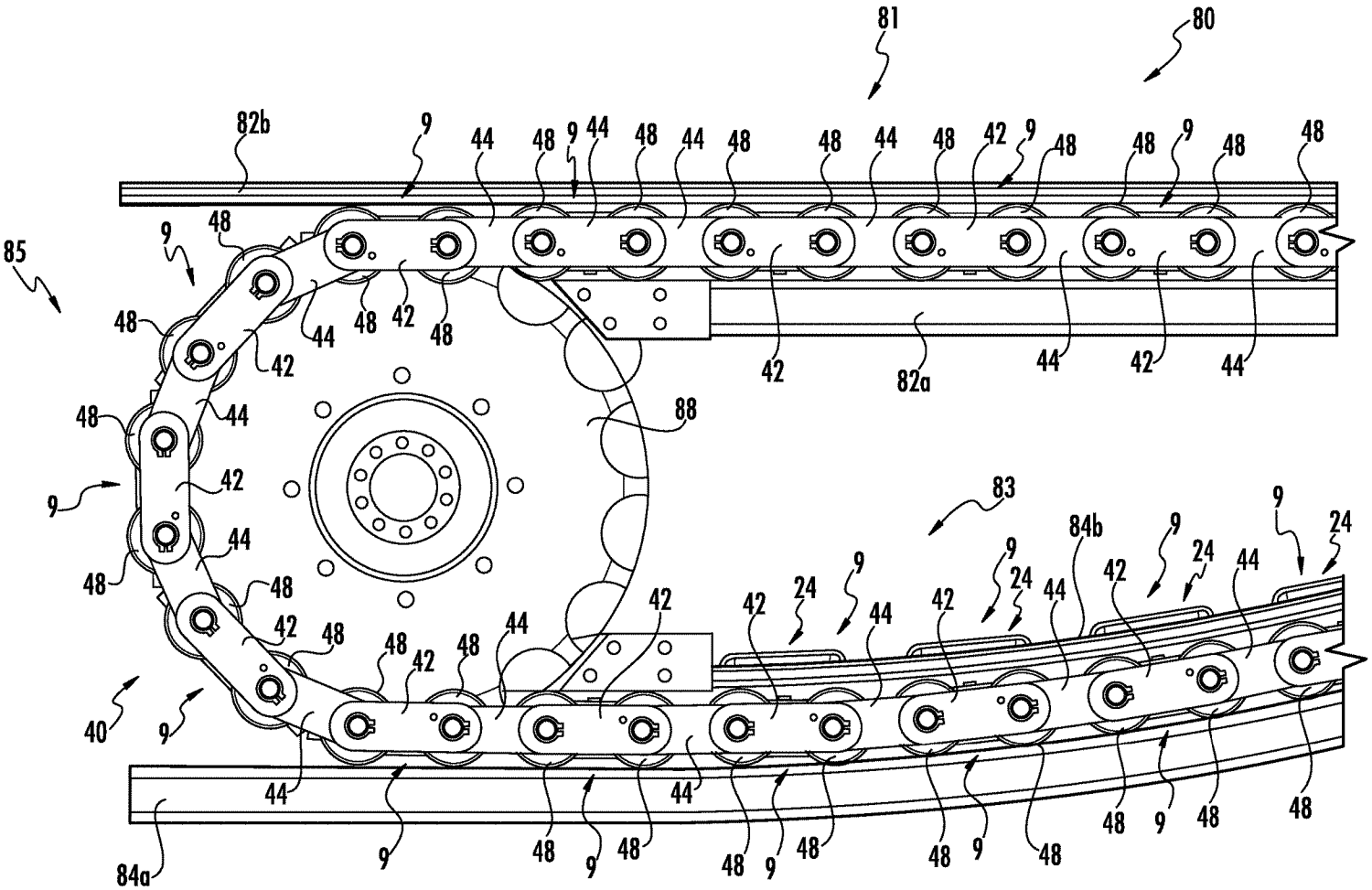
FIG. 13 shows a side view of the pallet conveyor according to the second exemplary embodiment.

FIGS. 12 and 13 illustrate a perspective view and a side view of a turnaround portion 85 of a pallet conveyor 80 according to a second exemplary embodiment.

In order to simplify the illustration, the comb plate 74 and the comb 76, which are present in a pallet conveyor 80 according to the second embodiment as well, are not shown in FIGS. 3 and 4. Instead, an upper guide rail 82*a* supporting the pallet chain 40 along the upper transportation portion 81 and a lower guide rail 84*a* supporting the pallet chain 40 along the lower return portion 83 are shown.

Up-thrust tracks 82*b*, 84*b* are provided opposite to the guide rails 82*a*, 84*a* with the chain links 42, 44 being sandwiched between the guide rails 82*a*, 84*a* and the up-thrust tracks 82*b*, 84*b*. Sandwiching the chain links 42, 44 between the guide rails 82*a*, 84*a* and the up-thrust tracks 82*b*, 84*b* avoids tilting of the chain links 42, 44 and the pallets 8, which otherwise might occur in particular in case high loads are applied to the pallets 8 moving along the upper transportation portion 81 of the pallet conveyor 80.

The lower guide rail 84*a* in the return portion 83 has an arcuate shape for minimizing the vertical height of the pallet conveyor 80 in its intermediate section, i.e. in the section between the turnaround portions 85, which is shown on the right side of FIG. 12.

The pallet conveyor 80 according to the second embodiment shown in FIGS. 12 and 13 is constructed similarly to the pallet conveyor 70 according to the first embodiment shown in FIGS. 10 and 11. In particular, the pallet conveyor 80 also comprises two pallet chains 40 comprising outer pallet chain links 42 and inner pallet chain links 44 connected to each other alternately. As in the embodiment shown in FIGS. 10 and 11, each pallet chain 40 comprises two pallet chain links 42, 44 per pallet 8, and the pallets 8 are non-rotatably connected to every second pallet chain link 42, 44, in particular to the outer pallet chain links 42. Thus, also in the embodiment of FIGS. 12 and 13, the outer pallet chain links 42 form first pallet chain links, and the inner pallet chain links 44 form second pallet chain links. Reference is made to the above description with respect to FIGS. 10 and 11 which applies in the same way with respect to FIGS. 12 and 13.

In the pallet conveyor 80 according to the second embodiment shown in FIGS. 12 and 13, the turnaround sprocket 88 comprises sixteen teeth instead of five teeth. As a result, the height of the turnaround portion 85 is considerably larger than in the first embodiment shown in FIGS. 10 and 11. The increased number of teeth reduces the polygonal effect of the pallet chains 40 and thus may avoid the need for additional means for compensating of the polygonal effect.

As in the pallet conveyor 80 according to the second embodiment the radius of the turnaround sprocket 88 is considerably larger than in the pallet conveyor 70 according to the first embodiment, the pallet carrier bodies 24 of the pallets 8 may be formed basically rectangularly in cross-section without causing the risk of interference in the turnaround portions 85.

The pallets 8 in particular may be formed as basically rectangular metal profiles, as shown in FIGS. 2 and 3.

Contrary to the first embodiment there are no pallet rollers 54 provided outside the pallet chain links 42, 44. Instead, the pallet chain rollers 48, which engage with the teeth of the turnaround sprocket 88, are also configured for supporting the pallet chain 40 and the pallets 8 on the guide rails 82, 84. This avoids the need of providing additional pallet rollers.

The skilled person will understand that pallet rollers 54, as they are shown in FIGS. 10 and 11, may also be used in combination with the a turnaround sprocket 88 comprising sixteen teeth according to the second embodiment. On the other hand, a turnaround sprocket 78 comprising only five teeth according to the first embodiment may be employed without providing additional pallet rollers 54.

The skilled person will further understand that the number of five or sixteen teeth for the turnaround sprockets 78, 88 is only exemplary and that any number of teeth, which is considered appropriate, may be used.

Further, it is not mandatory that the number of pallet chain links 42, 44 of each pallet chain 40, 50 is twice as large as the number of pallets 8. Instead, with N being a positive integer, N pallet chain links 42, 44 may be used per pallet 8 when the extension of the treads 27 in the conveying direction is N-times larger than the extension of the pallet chain links 42, 44 in said conveying direction.

FIGS. 14 and 15 show a perspective view and a top view of a portion of a pallet conveyor 90 according to a third embodiment, respectively.

In said third embodiment, the pallet chain 90 is provided by a standard chain, as specified in ISO606 or ISO1275, modified by extended pallet chain bolts 46 as described below. The pallet chain 90 comprises outer pallet chain links 42 and inner pallet chain links 44 alternately connected to each other by means of pallet chain bolts 46 providing the joints of the pallet chain 90. Pallet chain rollers 52 are supported within the pallet chain links 42, 44 by the pallet chain bolts 46.

The pallet chain bolts 46 provide the axles of the pallet chain rollers 52 and protrude from the side of the pallet chain 90 facing the pallets 8 thereby forming extensions 47. The extensions 47 of the pallet chain bolts 46 extending from the pallet chain 90 provide fixing elements. The extensions 47/fixing elements are configured to be received by brackets 14 formed on the sides of the fixing modules 2 facing the pallet chain 90. The fixing modules 2 are securely attached to the pallets 8 and allow to securely connect the pallets 8 to the pallet chain 90, as it has been described before.

Each of the fixing modules 2 supports two pallet rollers 54. The pallet rollers 54 are configured for supporting the pallets 8 and the pallet chain 90 on corresponding guide rails, which are not shown in FIGS. 14 and 15, but which are similar to the guide rails 82*a*, 84*a* shown in FIGS. 12 and 13.

In alternative embodiments, which are not shown in the figures, the pallet rollers 54 may be attached directly to the pallets 8. This allows the pitch of the pallet chain 40, 50, 90 to deviate from the distance between adjacent pallet rollers 54. This in particular allows to increase the distance between adjacent pallet rollers 54 as much as possible for reducing a possible tilting of the pallets 8.

In the embodiment shown in FIGS. 14 and 15 the pitch of the pallet band is four times larger than the pitch of the pallet chain 90. In consequence, only every fourth pallet chain link 42, 44 is connected, by means of a fixing module 2, to one of the pallets 8. Thus, only every fourth of the pallet chain links 42, 44 forms a first pallet chain link. The remaining of the pallet chain links 42, 44 form second pallet chain links. As with the embodiments described before, there is no relative movement between each of the pallets 8 and the first pallet chain link 42 to which it is connected. The remaining other pallet chain links (in the embodiment of FIGS. 14 and 15, two inner pallet chain links 44 and one outer pallet chain link 42) are not directly connected to any pallet 8. Rather, these other pallet chain links form second pallet chain links connecting two adjacent first pallet chain links with each other and simultaneously connecting two adjacent pallets 8 with each other to form the pallet band. While in the embodiment of FIGS. 14 and 15 outer pallet chain links 42 forms the first pallet chain links, configurations are conceivable where at least part of the inner pallet chain links 44 form the first pallet chain links.

Again, the number of four pallet chain links 42, 44 per pallet 8 is only exemplary and other ratios between the number of pallets 8 and the number of pallet chain links 42, 44 may be used as well.

In FIG. 14 the pallets 8 are shown without treads 27. In FIG. 15, treads 27 are installed on corresponding upper portions 24*a* of the pallet carrier bodies 24.

The upper portions 24*a* comprise a plurality of openings 23, e.g. screw holes. These openings 23 allow to fix the treads 27 to the upper portions 24*a* by means of bolts, screws, or alternative appropriate fixing elements extending into or through the openings 23.

FIGS. 16 to 19 illustrate cross sectional views of exemplary embodiments of pallets 8.

Figure 16:
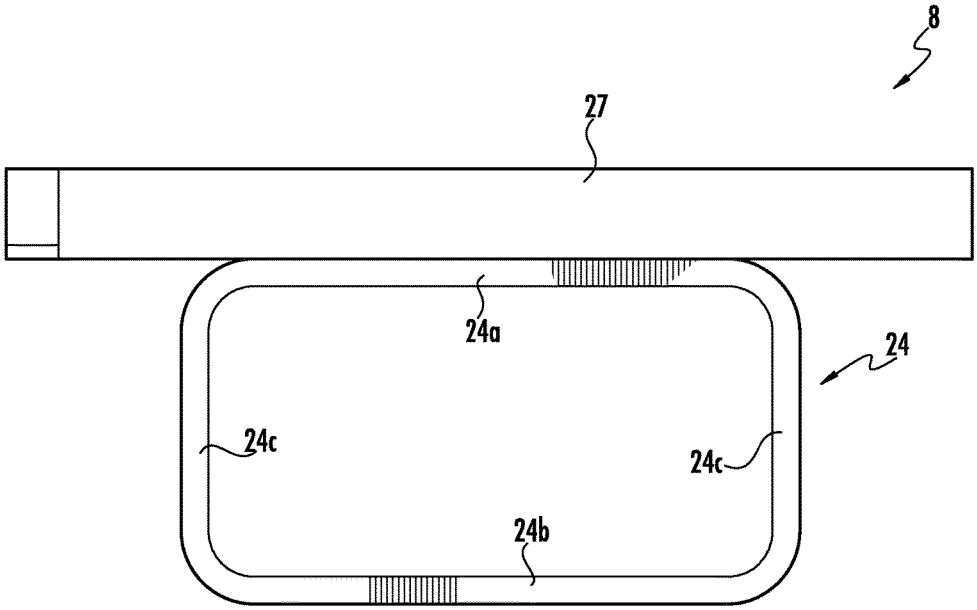
FIG. 16 illustrates a cross sectional view of an exemplary embodiment of a pallet.

FIG. 16 illustrates a cross sectional view of a pallet 8 as it may be used in a pallet conveyor 80 having a relatively large turnaround radius, e.g. a pallet conveyor 80 as it is depicted in FIGS. 12 and 13.

In such a pallet conveyor 80 there is more design space in the turnaround portion 85 than in a pallet conveyor 70 having a smaller turnaround radius, i.e. a pallet conveyor 70 as it is shown in FIGS. 10 and 11. Thus, in this case, pallet carrier bodies 24 having the form of a substantially rectangular hollow profile comprising an upper portion 24*a*, a lower portion 24*b*, which is oriented parallel to the upper portion, and two intermediate portions 24*c* respectively extending perpendicularly between the upper portion 24*a* and the lower portion 24*b* may be used. The tread 27 is attached to the upper portion 24*a* of the pallet carrier body 24.

In case of a relatively small turnaround radius, e.g. in an embodiment of a pallet conveyor 70 as it is shown in FIGS. 10 and 11, however, there is much less space in the turnaround portion 75 for accommodating the pallet carrier bodies 24 of adjacent pallets 8.

In order to avoid interference between adjacent pallet carrier bodies 24 in such configurations with a small turnaround radius, an alternative design for the pallet carrier body 24 should be used.

Figure 17:
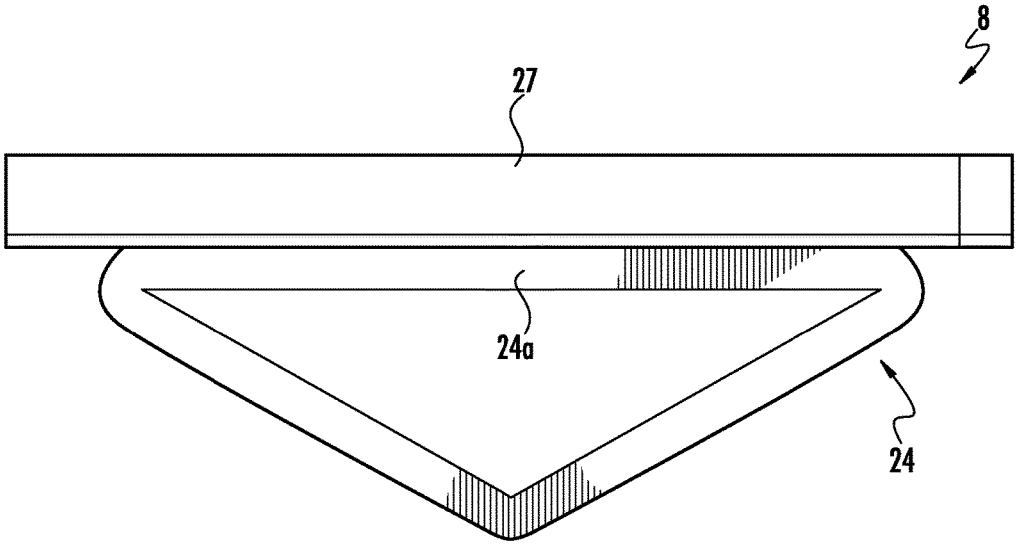
FIG. 17 illustrates a cross sectional view of another exemplary embodiment of a pallet.

An exemplary embodiment of such an alternative design is shown in FIG. 17. According to this embodiment, the pallet carrier body 24 is formed as a hollow profile having a triangular cross section instead of the rectangular cross section as it is shown in FIG. 16. Again, the tread 27 is attached to the upper portion 24*a* of the pallet carrier body 24. Such a triangular section cross avoids interference between adjacent pallet carrier bodies 24 in the turnaround portions 75, 85 in particular in configurations in which the turnaround radius is comparatively small.

FIGS. 16 and 17 respectively illustrate two extreme examples of the cross section of the pallet carrier body 24. However, intermediate cross sections in between a rectangular cross section, as it is shown in FIG. 16, and a triangular cross section, as it is shown in FIG. 17, may be employed as well.

Figure 18:
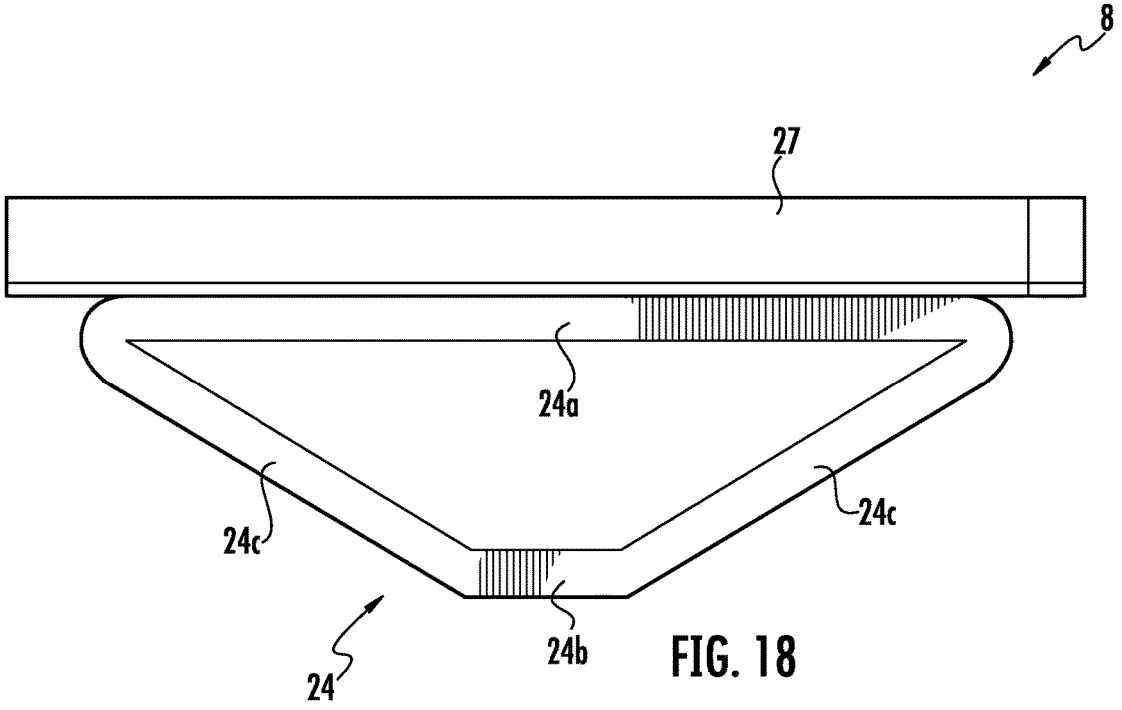
FIG. 18 illustrates a cross sectional view of yet another exemplary embodiment of a pallet.
Figure 19:
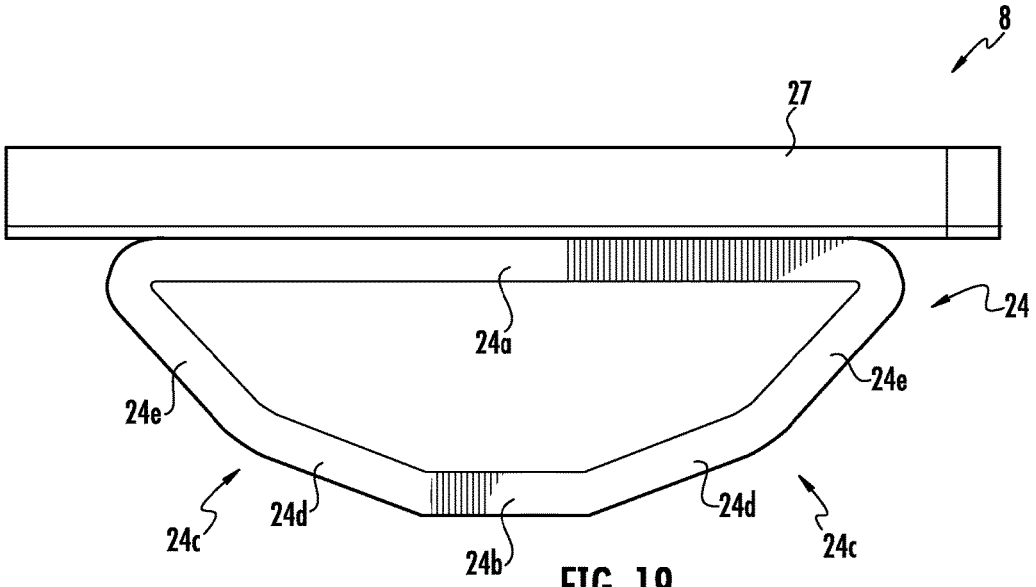
FIG. 19 illustrates a cross sectional view of a further exemplary embodiment of a pallet.

Two exemplary embodiments of such intermediate cross sections are shown in FIGS. 18 and 19.

FIG. 18 illustrates a pallet 8, in which the hollow profile forming the pallet carrier body 24 has a trapezoidal cross section. The pallet carrier body 24 in particular comprises an upper portion 24*a* and a lower portion 24*b* extending parallel to each other, and two inclined intermediate portions 24*c* respectively connecting the upper portion 24*a* with the lower portion 24*b*. In order to avoid interference between the pallet carrier bodies 24 of adjacent pallets 8 in the turnaround portions 75 in case of small turnaround radii, the extension of the lower portion 24*b* in the conveying direction, i.e. from left to right in FIG. 18, is considerably smaller than the extension of the upper portion 24*a* in said direction.

FIG. 19 illustrates a further embodiment of a pallet 8, which is similar to the embodiment shown in FIG. 18. Again, the pallet carrier body 24 includes an upper portion 24*a* and a lower portion 24*b* extending parallel to each other, and the extension of the lower portion 24*b* in the conveying direction is considerably smaller than the extension of the upper portion 24*a* in said direction in order to avoid interference between adjacent pallet carrier bodies 24 in the turnaround portions 75.

In the embodiment illustrated in FIG. 19, each of the inclined intermediate portions 24*c* connecting the upper portion 24*a* with the lower portion 24*b* comprises two sections 24*d*, 24*e*: a lower section 24*d* adjacent to the lower portion 24*b* of the pallet carrier body, and an upper section 24*e* adjacent to the upper portion 24*a* of the pallet carrier body 24. The upper end of the lower section 24*d* is connected to the lower end of the upper section 24*e*. The upper sections 24*e* are inclined with respect to the upper and lower portions 24*a*, 24*b* of the pallet carrier body 24 at an angle which is larger than the angle of the lower sections 24*d*.

The skilled person will understand that pallet carrier bodies 24 formed as profiles in which the inclined intermediate portions 24*b* comprise more than two sections 24*d*, 24*e* are possible as well. The upper portion 24*a* and the lower portion 24*b* of the pallet carrier body 24 even may be connected to each other by an arcuate intermediate portion (not shown in the Figures) providing a smooth transition between the upper portion 24*a* and the lower portion 24*b* of the pallet carrier body 24.

A fixing module according to exemplary embodiments of the invention, as it has been described facilitates the installation of pallets 8 to the pallet chain 40, 50 of a pallet conveyor 70, 80. It further allows to remove the pallets 8 not only in the turnaround sections 75, 85 but also in the straight parts of the pallet conveyor 70, 80.

As a result, not only the installation but also the maintenance of the pallet conveyor is considerably facilitated.

A number of optional features are set out in the following. These features may be realized in particular embodiments, alone or in combination with any of the other features.

Further, the at least one moveable securing element may be a clamping element, in particular a clamping plate, which is configured to be pressed against the at least one fixing element. A clamping element/plate provides a simple and reliable securing element. The clamping element/plate may be configured to transfer large loads, particularly in connection with a suitable securing mechanism, like a bolt or a screw.

Further, the securing mechanism may comprise a tightening element, e.g. a screw, which is configured for pressing the moveable securing element against the at least one corresponding fixing element. This provides a simple and reliable securing mechanism. In particular, the securing mechanism may be configured to allow transfer of the loads applied by the pallet and any goods/persons transported by the pallet to a guiding structure of the conveyor. For example a securing mechanism using a screw or bolt may be suitable for transferring such loads.

Further, the fixing module or pallet may comprise an alignment protrusion or flap which is configured for interacting with a pallet chain link in order to align the pallet chain side of the fixing module or pallet with respect to the pallet chain link.

Such an alignment protrusion or flap allows for an exact positioning of the pallet between the pallet chain links of two pallet chains which are arranged on both side of the pallet. This feature is beneficial as the pallets act as distance keepers between the pallet chains laterally arranged on both sides of the pallets. The lateral position of two consecutive pallets shall be kept constant for providing a smooth entry of the pallet cleating into the comb and for avoiding interference.

In an embodiment the pallet chain side of the fixing module or the pallet may be configured for receiving at least two fixing elements, in particular at least two bolts of the pallet chain. Receiving at least two fixing elements in the fixing module or in the pallet allows for a reliably non-rotatable connection between the pallet chain and the pallet.

Further, the pallet chain may comprise bolts protruding from the pallet chain links and being configured for being received by the pallet chain side of a fixing module or pallet according to an exemplary embodiment of the invention. Using at least two bolts of the pallet chain as fixing elements allows for easy manufacturing as there is no need for providing additional fixing elements. Usually, the pallet chain bolts are manufactured precisely. Therefore, fixing the pallets to the pallet chain bolts allows for a precise connection of the pallets and the pallet chain without requiring any further modifications of the pallets or the pallet chain.

Further, the securing element may comprise at least one opening allowing to hang the securing element to the at least one fixing element. This facilitates the installation of the securing element and prevents the securing element from falling down in the case of deinstallation.

Further embodiments may include a pallet comprising a receiving space which is configured for receiving the connection portion of a fixing module according to an exemplary embodiment as described herein. Such a receiving space allows for an easy, stable and secure connection between the pallet and the fixing module.

Further, the pallet may comprise a tread and a pallet carrier body. Then, the receiving space may be formed within the pallet carrier body or between the tread and the pallet carrier body. This allows to provide a stable connection between the pallet and the fixing module without increasing the height of the pallet.

Further embodiments may relate to a pallet assembly including a pallet as described above and a fixing module as described above.

In an embodiment the pallet assembly may comprise a pallet assembly fixing module configured for fixing the fixing module to the pallet. The pallet assembly fixing module in particular may comprise at least one screw or bolt. A pallet assembly fixing module allows for securely fixing the fixing module to the pallet. In particular, the pallet assembly fixing module may be configured to allow transfer of the loads applied by the pallet and any goods/persons transported by the pallet to a guiding structure of the conveyor. For example a pallet assembly fixing module using screws or bolts may be suitable for transferring such loads.

Embodiments of the invention further include a pallet chain comprising a plurality of pallet chain links connected by pallet chain bolts, wherein at least part of the pallet chain bolts protrude from the pallet chain links and are configured for being received by a pallet chain side of a fixing module as described herein, or by a fixing portion of a pallet as described herein.

Further embodiments include a pallet conveyor drive mechanism comprising a plurality of fixing modules as described herein or a plurality of pallets as described herein, and at least one pallet chain, in particular a pallet chain as described above.

Further embodiments include a pallet conveyor, in particular a people conveyor, comprising a pallet conveyor drive mechanism as described above.

Although the term pallet is used throughout the present disclosure, it is to be understood that the present invention is applicable to pallet conveyors of any type, particularly to moving walkways or to escalators. In escalators, the pallets are usually referred to as steps and it goes without saying that with respect to an escalator the term pallet, as used herein, refers to the steps or parts of the steps (like tread, riser, skirt panels, etc.).

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention include all embodiments falling within the scope of the claims.

REFERENCES

2 fixing module
4 pallet side of the fixing module
6 connection portion
8 pallet
10 pallet chain side
11 fixing portion
12 securing element
13 recess in the securing element
14 bracket
16 tightening element
18 alignment protrusion
20 receiving space
23 openings
24 pallet carrier body
24*a* upper portion pallet carrier body
24*b* lower portion pallet carrier body
24*c* intermediate pallet carrier body
24*d* lower section of the intermediate portion of the pallet carrier body
24*e* upper section of the intermediate portion of the pallet carrier body
25 openings
27 tread
30 additional plate
32 connection block
40 pallet chain (second embodiment)
42 outer pallet chain link
42*a*, 42*b* outer pallet chain link plates
44 inner pallet chain link
44*a*, 44*b* inner pallet chain link plates
45 intermediate bolt
46 pallet chain link bolt
47 extension of the pallet chain link bolt
48 pallet chain roller (second embodiment)
50 pallet chain (first embodiment)
52 pallet chain roller (third embodiment)
54 pallet roller
60 installation plate
62 opening in the installation plate
64 retaining flap
70 pallet conveyor (first embodiment)
71 transportation portion (first embodiment)
73 return portion (first embodiment)
74 comb plate
75 turnaround portion (first embodiment)
76 comb
78 turnaround sprocket (first embodiment)
80 pallet conveyor (second embodiment)
81 transportation portion (second embodiment)
82*a* guide rail (in the transportation portion)
82*b* up-thrust tracks (in the transportation portion)
83 return portion (second embodiment)
84*a* guide rail (in the return portion)
84*b* up-thrust tracks (in the return portion)
85 turnaround portion (second embodiment)
88 turnaround sprocket (second embodiment)
90 pallet chain (third embodiment)

What is claimed is:

1. A fixing module for fixing a pallet of a pallet conveyor to a pallet chain comprising a plurality of pallet chain links, the fixing module comprising:

a pallet side comprising a connection portion, which is configured to be fixed in a non-rotatable manner to a pallet of the pallet conveyor;

a pallet chain side, which is configured for facing the pallet chain and for receiving at least one fixing element protruding from the pallet chain; and a securing mechanism, comprising at least one moveable securing element which is configured for securing the at least one fixing element within the fixing module so that the fixing module is non-rotatably fixed to at least one pallet chain link of the pallet chain.

2. The fixing module according to claim 1, wherein the at least one moveable securing element is a clamping element or plate which is configured to be pressed against the at least one fixing element.

3. The fixing module according to claim 1, wherein the pallet chain side is configured for receiving at least two pallet chain link bolts of the pallet chain.

4. The fixing module according to claim 1, wherein the securing mechanism comprises a tightening element which is configured for pressing the moveable securing element against the at least one fixing element.

5. The fixing module according to claim 1, comprising an alignment protrusion which is configured for interacting with the at least one pallet chain link for aligning the fixing module or pallet with respect to the pallet chain link.

6. The fixing module according to claim 1, wherein the moveable securing element comprises at least one opening allowing to hang the moveable securing element to the at least one fixing element.

7. The fixing module according to claim 1, wherein the moveable securing element comprises at least one retaining flap which is configured for aligning the pallet chain side of the fixing module or pallet in the longitudinal direction of the pallet chain.

8. A pallet for a pallet conveyor, the pallet including a fixing portion for fixing the pallet to a pallet chain comprising a plurality of pallet chain links, comprising:

a pallet chain side, which is configured for facing the pallet chain and for receiving at least one fixing element extending from the pallet chain; and a securing mechanism, comprising at least one moveable securing element which is configured for securing the at least one fixing element within the pallet so that the pallet is non-rotatably fixed to the at least one pallet chain link of the pallet chain.

9. A pallet for a pallet conveyor, comprising a receiving space which is configured for receiving a connection portion of a fixing module, the fixing module comprising:

a pallet side comprising a connection portion, which is configured to be fixed in a non-rotatable manner to a pallet of the pallet conveyor;

a pallet chain side, which is configured for facing the pallet chain and for receiving at least one fixing element protruding from the pallet chain; and a securing mechanism, comprising at least one moveable securing element which is configured for securing the at least one fixing element within the fixing module so that the fixing module is non-rotatably fixed to at least one pallet chain link of the pallet chain.

10. The pallet according to claim 9, wherein the pallet comprises a tread and a pallet carrier body, and wherein the receiving space is formed within the pallet carrier body or between the tread and the pallet carrier body.

11. A pallet assembly comprising a fixing module comprising:

a pallet side comprising a connection portion, which is configured to be fixed in a non-rotatable manner to a pallet of the pallet conveyor;

a pallet chain side, which is configured for facing the pallet chain and for receiving at least one fixing element protruding from the pallet chain; and a securing mechanism, comprising at least one moveable securing element which is configured for securing the at least one fixing element within the fixing module so that the fixing module is non-rotatably fixed to at least one pallet chain link of the pallet chain;

the pallet assembly further comprising a pallet comprising a receiving space which is configured for receiving the connection portion of a fixing module.

12. The pallet assembly according to claim 11, comprising a pallet assembly fixing mechanism which is configured for fixing the fixing module to the pallet, wherein the pallet assembly fixing mechanism comprises at least one screw or bolt.

13. A pallet chain comprising a plurality of pallet chain links connected by pallet chain bolts, wherein at least part of the pallet chain bolts protrude from the pallet chain links and are configured for being received by a pallet chain side of a fixing module, the fixing module comprising:

a pallet side comprising a connection portion, which is configured to be fixed in a non-rotatable manner to a pallet of the pallet conveyor;

a pallet chain side, which is configured for facing the pallet chain and for receiving at least one fixing element protruding from the pallet chain; and a securing mechanism, comprising at least one moveable securing element which is configured for securing the at least one fixing element within the fixing module so that the fixing module is non-rotatably fixed to at least one pallet chain link of the pallet chain.

14. A pallet conveyor comprising a pallet conveyor drive mechanism, the drive mechanism comprising a plurality of fixing modules, the fixing module comprising:

a pallet side comprising a connection portion, which is configured to be fixed in a non-rotatable manner to a pallet of the pallet conveyor;

a pallet chain side, which is configured for facing the pallet chain and for receiving at least one fixing element protruding from the pallet chain; and a securing mechanism, comprising at least one moveable securing element which is configured for securing the at least one fixing element within the fixing module so that the fixing module is non-rotatably fixed to at least one pallet chain link of the pallet chain, and at least one pallet chain.

15. A pallet chain comprising a plurality of pallet chain links connected by pallet chain bolts, wherein at least part of the pallet chain bolts protrude from the pallet chain links and are configured for being received by a fixing portion of a pallet including a fixing portion for fixing the pallet to a pallet chain comprising a plurality of pallet chain links, comprising:

a pallet chain side, which is configured for facing the pallet chain and for receiving at least one fixing element extending from the pallet chain; and a securing mechanism, comprising at least one moveable securing element which is configured for securing the at least one fixing element within the pallet so that the pallet is non-rotatably fixed to the at least one pallet chain link of the pallet chain.

16. A pallet conveyor drive mechanism comprising a plurality of fixing modules, a fixing module comprising:

a pallet side comprising a connection portion, which is configured to be fixed in a non-rotatable manner to a pallet of the pallet conveyor;

a pallet chain side, which is configured for facing the pallet chain and for receiving at least one fixing element protruding from the pallet chain; and a securing mechanism, comprising at least one moveable securing element which is configured for securing the at least one fixing element within the fixing module so that the fixing module is non-rotatably fixed to at least one pallet chain link of the pallet chain, and at least one pallet chain.

17. A pallet conveyor drive mechanism according to claim 16, wherein the pallet chain comprises a plurality of pallet chain links connected by pallet chain bolts, wherein at least part of the pallet chain bolts protrude from the pallet chain links and are configured for being received by a pallet chain side of a fixing module, and wherein the fixing module comprises:

a pallet side comprising a connection portion, which is configured to be fixed in a non-rotatable manner to a pallet of the pallet conveyor;

a pallet chain side, which is configured for facing the pallet chain and for receiving at least one fixing element protruding from the pallet chain; and a securing mechanism, comprising at least one moveable securing element which is configured for securing the at least one fixing element within the fixing module so that the fixing module is non-rotatably fixed to at least one pallet chain link of the pallet chain.

* * * * *